US007618315B2

(12) United States Patent
Thomas et al.

(10) Patent No.: US 7,618,315 B2
(45) Date of Patent: Nov. 17, 2009

(54) WAGERING GAME WITH WRAP-AROUND PAYLINES

(75) Inventors: Alfred Thomas, Las Vegas, NV (US); Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 320 days.

(21) Appl. No.: 11/351,666

(22) Filed: Feb. 10, 2006

(65) Prior Publication Data

US 2007/0191087 A1 Aug. 16, 2007

(51) Int. Cl.
*A63F 9/24* (2006.01)

(52) U.S. Cl. ..... 463/20

(58) Field of Classification Search ..... 463/10–13, 463/16–22

See application file for complete search history.

(56) References Cited

U.S. PATENT DOCUMENTS

| | | | | |
|---|---|---|---|---|
| 4,624,459 | A | 11/1986 | Kaufman | 273/143 R |
| 4,837,728 | A | 6/1989 | Barrie et al. | 364/412 |
| 4,948,134 | A | 8/1990 | Suttle et al. | 273/85 |
| 5,116,055 | A | 5/1992 | Tracy | 273/138 A |
| 5,249,800 | A | 10/1993 | Hilgendorf et al. | 273/138 A |
| 5,275,400 | A | 1/1994 | Weingardt et al. | 463/12 |
| 5,280,909 | A | 1/1994 | Tracy | 273/138 A |
| 5,344,144 | A | 9/1994 | Canon | 273/138 A |
| 5,377,973 | A | 1/1995 | Jones et al. | 273/85 CP |
| 5,393,057 | A | 2/1995 | Marnell | 273/85 CP |
| 5,524,888 | A | 6/1996 | Heidel | 463/22 |
| 5,544,892 | A | 8/1996 | Breeding | 273/292 |
| 5,564,700 | A | 10/1996 | Celona | 463/27 |
| 5,580,053 | A | 12/1996 | Crouch | 463/20 |
| 5,580,063 | A | 12/1996 | Edwards | 273/378 |
| 5,580,309 | A | 12/1996 | Piechowiak et al. | 463/16 |
| 5,611,535 | A | 3/1997 | Tiberio | 273/143 R |
| 5,611,730 | A | 3/1997 | Weiss | 463/20 |
| 5,645,486 | A | 7/1997 | Nagao et al. | 463/27 |
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |

(Continued)

FOREIGN PATENT DOCUMENTS

CA 2334546 A1 8/2001

(Continued)

OTHER PUBLICATIONS

Article for "Easy Riches" by Sigma Game, Strictly Slots, 1 page (Aug. 2001).

(Continued)

*Primary Examiner*—John M Hotaling
*Assistant Examiner*—Eric M Thomas
(74) *Attorney, Agent, or Firm*—Nixon Peabody LLP

(57) ABSTRACT

A method of conducting a wagering game includes receiving a wager from a player for playing the wagering game. An array of symbol-bearing locations and at least one payline is displayed along a plurality of the symbol-bearing locations. The plurality of the symbol-bearing locations includes first and second non-adjacent outer locations. The method further includes evaluating symbols at the symbol-bearing locations along the payline for winning outcomes such that symbols at the first and second non-adjacent outer locations are evaluated in sequence.

27 Claims, 21 Drawing Sheets

U.S. PATENT DOCUMENTS

| | | | | |
|---|---|---|---|---|
| 5,779,549 | A | 7/1998 | Walker et al. | 463/42 |
| 5,807,172 | A | 9/1998 | Piechowiak | 463/20 |
| 5,816,918 | A | 10/1998 | Kelly et al. | 463/16 |
| 5,823,874 | A | 10/1998 | Adams | 463/17 |
| 5,830,063 | A | 11/1998 | Byrne | 463/18 |
| 5,848,932 | A | 12/1998 | Adams | 463/20 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 6,007,427 | A | 12/1999 | Wiener et al. | 463/17 |
| 6,012,982 | A | 1/2000 | Piechowiak et al. | 463/16 |
| 6,039,648 | A | 3/2000 | Guinn et al. | 463/16 |
| 6,047,963 | A | 4/2000 | Pierce et al. | 273/121 B |
| 6,077,162 | A | 6/2000 | Weiss | 463/26 |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,798 | A | 8/2000 | Bennett | 463/16 |
| 6,102,799 | A | 8/2000 | Stupak | 463/27 |
| 6,110,043 | A | 8/2000 | Olsen | 463/27 |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | 463/20 |
| 6,168,523 | B1 | 1/2001 | Piechowiak et al. | 463/26 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,254,483 | B1 | 7/2001 | Acres | 463/26 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | 463/26 |
| 6,322,445 | B1 | 11/2001 | Miller | 463/13 |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,358,149 | B1 | 3/2002 | Schneider et al. | 463/27 |
| 6,361,441 | B1 | 3/2002 | Walker et al. | 463/42 |
| 6,364,768 | B1 | 4/2002 | Acres et al. | 463/25 |
| 6,375,567 | B1 | 4/2002 | Acres | 463/25 |
| 6,375,568 | B1 | 4/2002 | Roffman et al. | 463/26 |
| 6,416,408 | B2 | 7/2002 | Tracy et al. | 463/16 |
| 6,416,409 | B1 | 7/2002 | Jordan | 463/27 |
| 6,422,940 | B1 | 7/2002 | Walker et al. | 463/13 |
| 6,431,983 | B2 | 8/2002 | Acres | 463/25 |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,589,115 | B2 | 7/2003 | Walker et al. | 463/25 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,604,999 | B2 | 8/2003 | Ainsworth | 463/20 |
| 6,648,753 | B1 | 11/2003 | Tracy et al. | 463/16 |
| 6,648,762 | B2 | 11/2003 | Walker et al. | 463/25 |
| 6,692,354 | B2 | 2/2004 | Tracy et al. | 463/16 |
| 6,712,695 | B2 | 3/2004 | Mothwurf et al. | 463/25 |
| 6,712,699 | B2 | 3/2004 | Walker et al. | 463/30 |
| 6,733,390 | B2 | 5/2004 | Walker et al. | 463/23 |
| 6,790,141 | B2 | 9/2004 | Muir | 463/42 |
| 6,805,349 | B2 * | 10/2004 | Baerlocher et al. | 273/138.2 |
| 6,837,793 | B2 | 1/2005 | McClintic | 463/42 |
| 6,869,357 | B2 | 3/2005 | Adams et al. | 463/16 |
| 6,869,361 | B2 | 3/2005 | Sharpless et al. | 463/25 |
| 6,966,835 | B2 | 11/2005 | Graham | 463/25 |
| 6,981,635 | B1 * | 1/2006 | Hughs-Baird et al. | 235/375 |
| 2002/0138594 | A1 | 9/2002 | Rowe | 709/219 |
| 2002/0151345 | A1 | 10/2002 | Byrne | 463/18 |
| 2002/0155874 | A1 | 10/2002 | Byrne | 463/16 |
| 2003/0027618 | A1 | 2/2003 | Byrne | 463/16 |
| 2003/0036430 | A1 | 2/2003 | Cannon | 463/42 |
| 2003/0045337 | A1 | 3/2003 | Byrne | 463/16 |
| 2003/0050106 | A1 | 3/2003 | Lyfoung | 463/13 |
| 2003/0064776 | A1 | 4/2003 | Byrne | 463/16 |
| 2003/0064807 | A1 | 4/2003 | Walker et al. | 463/42 |
| 2003/0069068 | A1 | 4/2003 | Kaminkow | 463/25 |
| 2003/0148808 | A1 | 8/2003 | Price | 463/27 |
| 2003/0181231 | A1 | 9/2003 | Vancura et al. | 463/9 |
| 2003/0186733 | A1 | 10/2003 | Wolf et al. | 463/16 |
| 2003/0203752 | A1 * | 10/2003 | Kaminkow et al. | 463/20 |
| 2003/0203753 | A1 * | 10/2003 | Muir et al. | 463/20 |
| 2003/0216165 | A1 | 11/2003 | Singer et al. | 463/20 |
| 2003/0216166 | A1 | 11/2003 | Baerlocher et al. | 463/20 |
| 2003/0222402 | A1 | 12/2003 | Olive | 273/292 |
| 2003/0224852 | A1 | 12/2003 | Walker et al. | 463/20 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0009811 | A1 | 1/2004 | Torango | 463/25 |
| 2004/0038741 | A1 | 2/2004 | Gauselmann | 463/42 |
| 2004/0048644 | A1 | 3/2004 | Gerrard et al. | 463/16 |
| 2004/0048657 | A1 | 3/2004 | Gauselmann | 463/25 |
| 2004/0077401 | A1 | 4/2004 | Schlottmann | 463/20 |
| 2004/0092299 | A1 | 5/2004 | Gauselmann | 463/16 |
| 2004/0106448 | A1 | 6/2004 | Gauselmann | 463/25 |
| 2004/0162133 | A1 | 8/2004 | Jackson | 463/20 |
| 2004/0195773 | A1 | 10/2004 | Masci et al. | 273/317 |
| 2004/0204226 | A1 | 10/2004 | Foster et al. | 463/20 |
| 2004/0204235 | A1 | 10/2004 | Walker et al. | 463/29 |
| 2004/0235552 | A1 | 11/2004 | Gauselmann | 463/16 |
| 2004/0242297 | A1 | 12/2004 | Walker et al. | 463/13 |
| 2004/0242303 | A1 | 12/2004 | Walker et al. | 463/16 |
| 2004/0242314 | A1 | 12/2004 | Casey | 463/20 |
| 2005/0014554 | A1 | 1/2005 | Walker et al. | 463/20 |
| 2005/0026674 | A1 | 2/2005 | Wolf et al. | 463/16 |
| 2005/0026676 | A1 | 2/2005 | Olive | 463/20 |
| 2005/0159208 | A1 | 7/2005 | Pacey | 463/20 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | | 8/1999 |
| WO | WO 99/03078 | A1 | 1/1999 |
| WO | WO 99/19037 | A1 | 4/1999 |
| WO | WO 01/33478 | A1 | 5/2001 |
| WO | WO 03/026754 | A1 | 4/2003 |
| WO | WO 03/083789 | A1 | 10/2003 |

OTHER PUBLICATIONS

Article for "Millioniser" by Glenn Haussman, Strictly Slots, pp. 50-53 (Mar. 2004).

Product Sheet for "Big Games Safari," IGT, 24 pages (2000).

"New '97 Games," International Gaming & Wagering Business, 24 pages (Mar. 1997).

Article for "Atronic Sphinx Magic" (Author Unknown), Strictly Slots, p. 49 (Feb. 2003).

Article for "Sphinx II—Son of Sphinx" by Frank Legato, Strictly Slots, pp. 42-44 (Nov. 2001).

Article for "Sphinx II/e-motion—Atronic Americas" (Author Unknown), Strictly Slots, pp. 44 (Mar. 2004).

* cited by examiner

WAGERING GAME WITH WRAP-AROUND PAYLINES

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine having wrap-around paylines.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

In slot-type wagering games, players typically select one or more paylines when placing a wager. In general, to achieve a line pay or trigger a special event or feature in some wagering games, a payline is a line along which a winning symbol or combination of symbols must appear to yield a payout or to trigger a special event or feature. Slot machines typically have anywhere between one and twenty or more paylines. One problem associated with current paylines is that they are limited to reel combinations that start at one outer reel (e.g., the leftmost reel) and end at another outer reel (e.g., the rightmost reel). By default, then, the number of available paylines is limited. Providing additional paylines can increase the technical, entertainment, and excitement value associated with the wagering game.

Thus, there is a need to increase the number of paylines for a wagering game. The present invention fulfills this and other needs.

SUMMARY OF THE INVENTION

According to one aspect of the present invention, a method of conducting a wagering game includes receiving a wager from a player for playing the wagering game. An array of symbol-bearing locations and at least one payline is displayed along a plurality of the symbol-bearing locations. The plurality of the symbol-bearing locations includes first and second non-adjacent outer locations. The method further includes evaluating symbols at the symbol-bearing locations along the payline for winning outcomes such that symbols at the first and second non-adjacent outer locations are evaluated in sequence.

According to another aspect of the invention, a method of conducting a wagering game includes receiving a wager and displaying an array of symbol-bearing locations and at least one payline sequentially connecting first and second non-adjacent outer locations of the array with no intervening symbol-bearing location.

According to yet another aspect of the invention, a gaming system for conducting a wagering game includes an input device for receiving a wager and a display for displaying an array of symbol-bearing locations and at least one payline along a plurality of the symbol-bearing locations. The plurality of the symbol-bearing locations includes first and second non-adjacent outer locations. The gaming system further includes a controller operative to evaluate symbols at the symbol-bearing locations along the payline for winning outcomes such that symbols at the first and second non-adjacent outer locations are evaluated in sequence.

According to yet another aspect of the invention, a gaming system for conducting a wagering game includes an input device for receiving a wager. The gaming system further includes a display for displaying an array of symbol-bearing locations and at least one payline sequentially connecting first and second non-adjacent outer locations of the array with no intervening symbol-bearing location.

According to yet another aspect of the invention, a computer readable storage medium is encoded with instructions for directing a gaming device to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1:
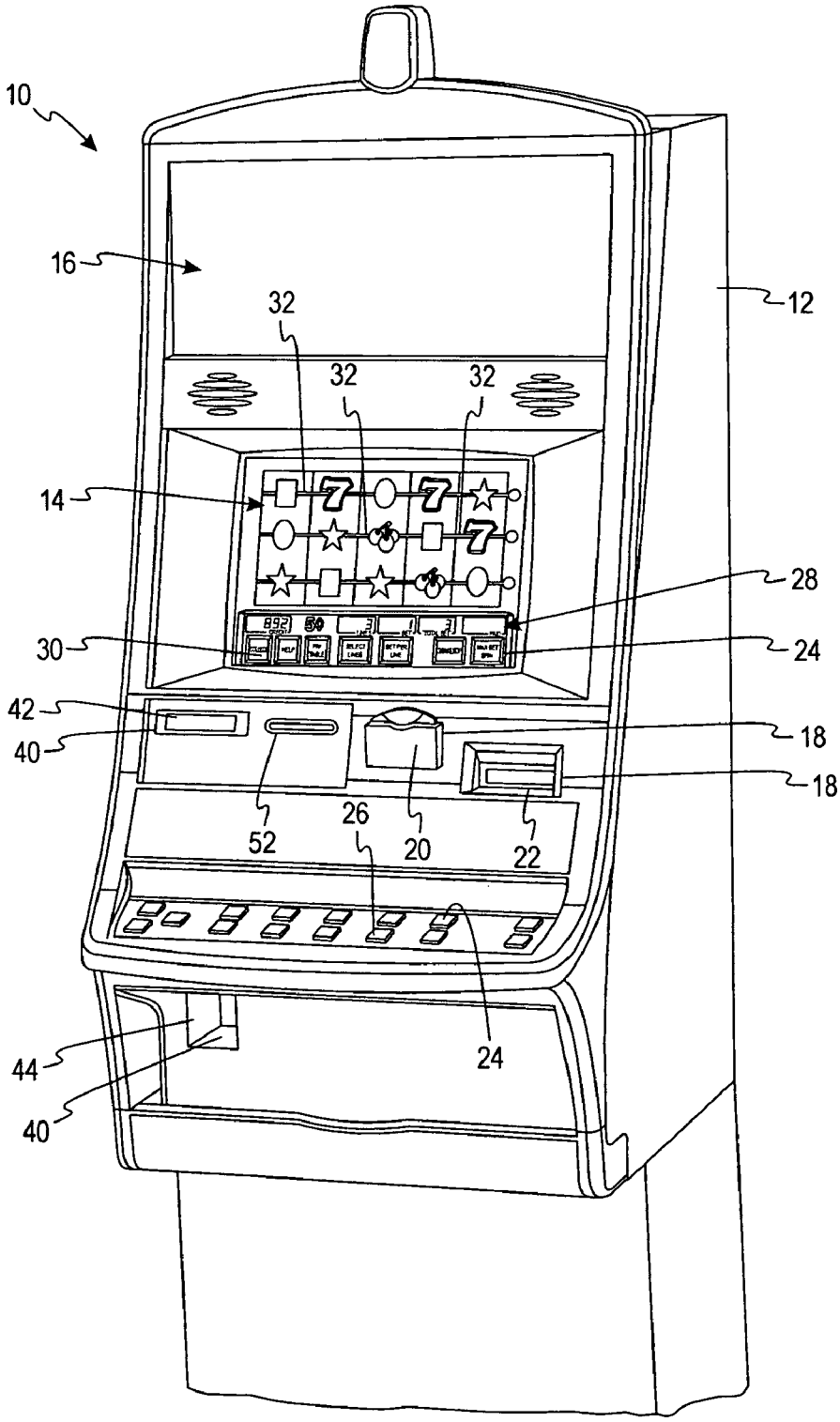
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual association to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
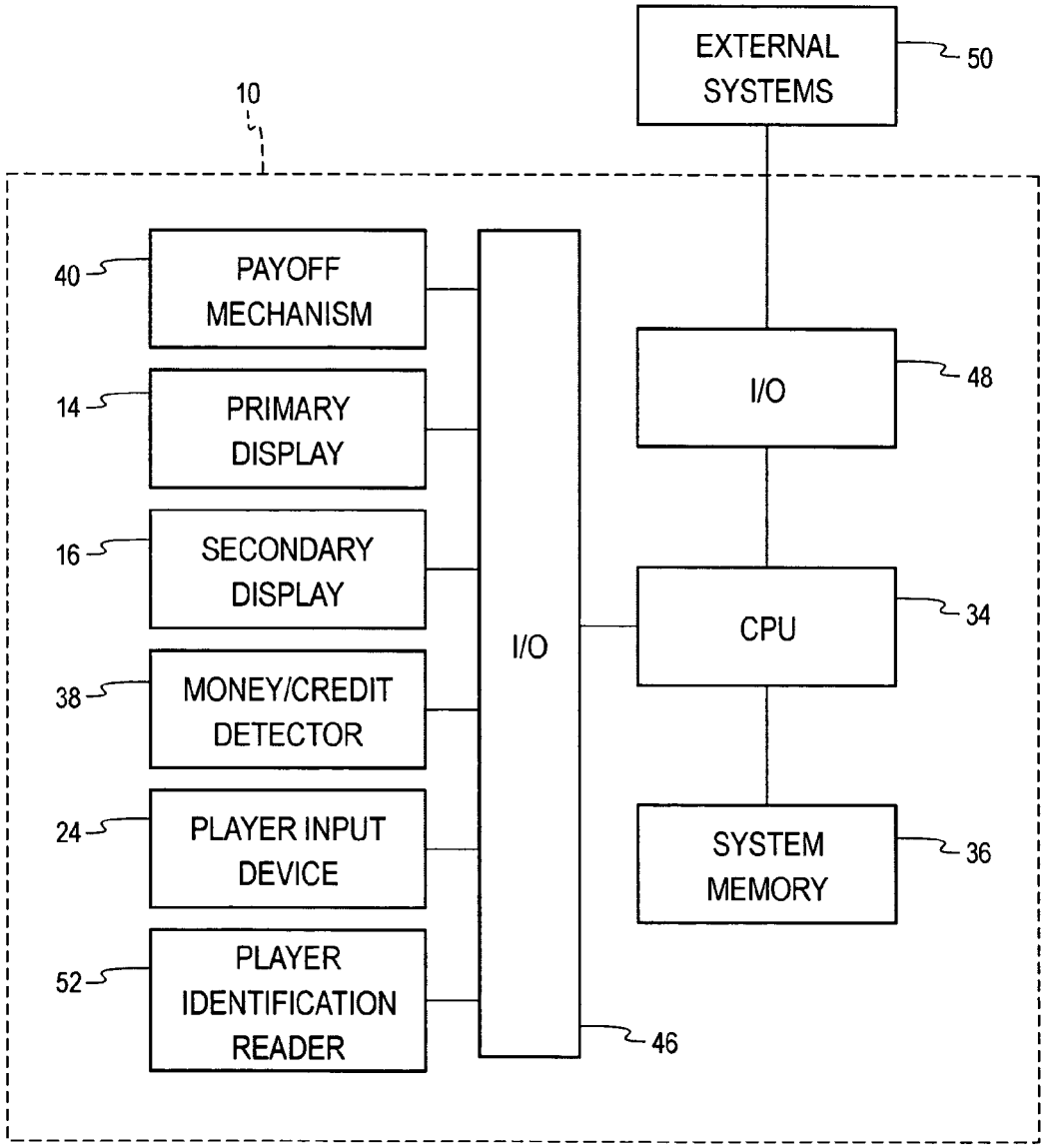
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10*b*T, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
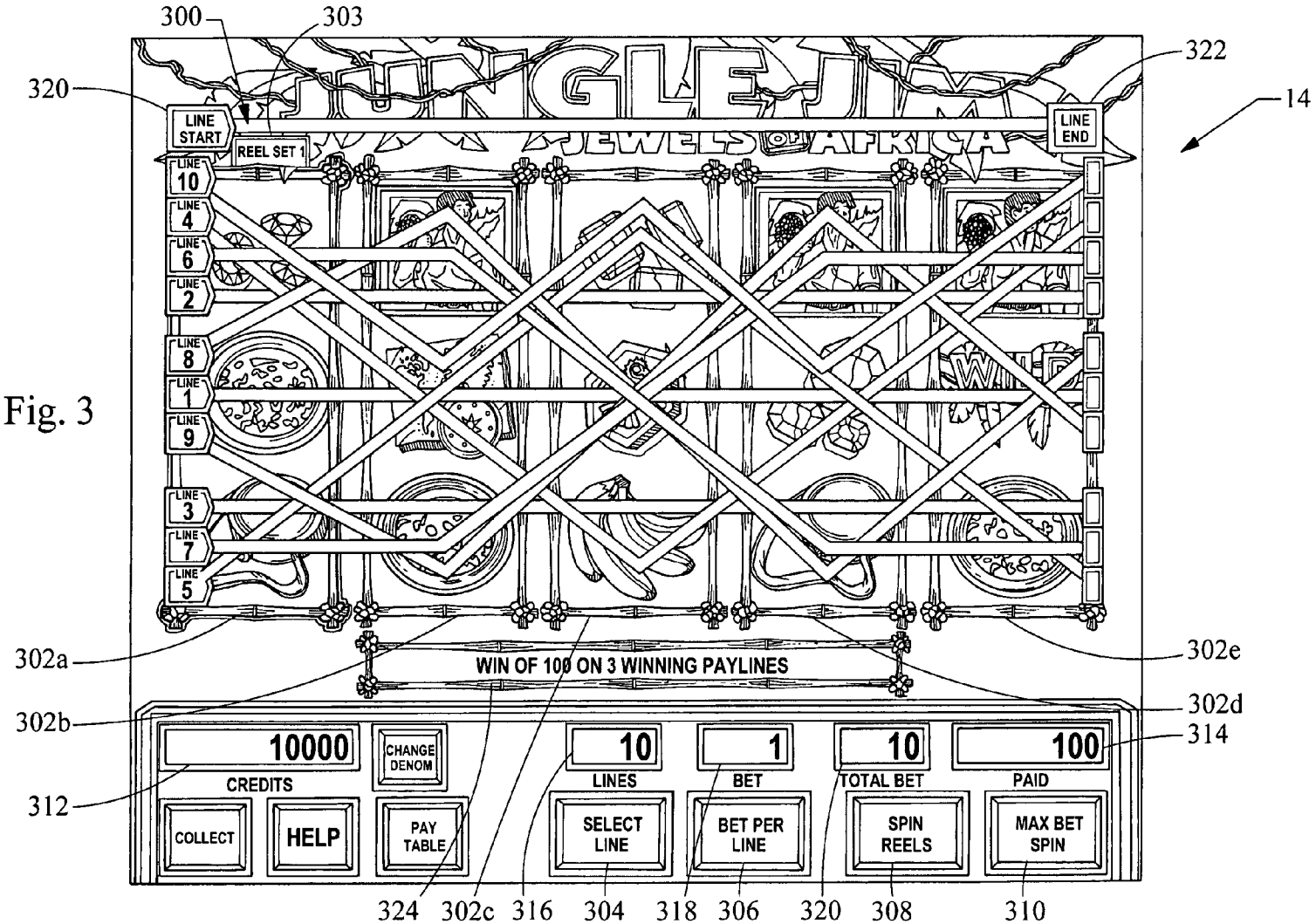
FIG. 3 is a representation of a game screen having ten active paylines, according to another embodiment of the present invention.

Turning now to FIG. 3, the primary display 14 shows a game screen 300 including a set of paylines (labeled Line 1-Line 10), a plurality of reels 302*a*-302*e*, a plurality of buttons, and a plurality of indicators. The paylines Line 1-Line 10 are standard paylines that are collectively identified as Reel Set 1 by a reel set indicator 303, that start at the first reel 302*a* and end at the fifth reel 302*e* (using a left-to-right configuration), and that extend across all five reels 302*a*-302*e*. For clarity to a player, a generally pentagonal-shaped border is used to depict the start of each payline, wherein the border surrounds the respective payline label and is shaped like an arrow to indicate the direction in which the symbols along the payline are evaluated. Similarly, a-smaller generally rectangular-shaped border is used to depict the end of each payline. The start and end shapes are connected by a line to representatively indicate the paylines of Reel Set 1. Alternatively, other shapes can be used to depict the start and/or end of each payline.

The plurality of buttons includes a Select Line button 304, a Bet Per Line button 306, a Spin Reels button 308, and a Max Bet Spin button 310. Pressing the Select Line button 304 selects at least one payline of Reel Set 1. For example, pressing the Select Line button 304 selects the entire set of paylines of Reel Set 1. Pressing the Bet Per Line button 306 selects a predetermined wager (or bet) for the selected paylines. For example, each time a player presses the Bet Per Line button 306 the wager increases to a next wager value (e.g., 1, 2, . . . 5, etc.). Optionally, if the wager reaches the highest value (e.g., 5) for that gaming machine 10, pressing the Bet Per Line button 306 resets the wager to a default value (e.g., 1).

Pressing the Spin Reels button 308 starts the spinning of the reels 302*a*-302*e*, which stop after a predetermined time or when an optional Stop Reels button is pressed.

Pressing the Max Bet Spin button 310 selects all the possible payline combinations at the maximum wager. For example, if the largest possible number of paylines is fifty paylines and the largest wager per payline is 5 credits, the total wager is 250 credits (50×5).

The plurality of indicators includes a Credits increment meter 312, a Paid increment meter 314, a Lines indicator 316, a Bet indicator 318, and a Total Bet indicator 320. The Credits increment meter 312 includes a Credits digits indicator, which is surrounded by a Credits window. The Credits digits indicator shows the value, or amount, of credits that is available to the player. The Paid increment meter 314 includes a Paid digits indicator, which is surrounded by a Paid window. The Paid digits indicator shows the value, or amount, of credits that the player has won during the current play of the wagering game.

The Lines indicator 316 shows the number of lines that are currently selected by the player. For example, if the player chooses five paylines, then the player is playing Lines 1-5 on the reel set. The Bet indicator 318 shows the wager selected by the player. The Total Bet indicator 320 shows the total number of credits that are being wagered by the player, i.e., the number of lines multiplied by the wager per payline. For example, the player has selected 10 paylines (as indicated by the Lines indicator 316) and a 1 credit wager per payline (as indicated by the Bet indicator 318) for a total number of 10 wagered credits (as indicated by the Total Bet indicator 320).

A Line Start indicator 320 indicates the start reel of Reel Set 1, while a Line End indicator 322 indicates the end reel of Reel Set 1. As shown, the Line Start indicator 320 is positioned above the first reel 302*a* because the paylines of Reel Set 1 begin at the first reel 302*a*. The Line Start 320 is in the shape of an arrow pointed from left to right to indicate that symbol combinations appearing along the paylines of Reel Set 1 are evaluated from left to right beginning from the first reel 302*a* and ending at the fifth reel 302*e*. Similarly, the Line End indicator 322 is positioned above the fifth reel 302*e* because the paylines of Reel Set 1 end at the fifth reel 302*e*. Alternatively, the Line Start indicator 320 and/or the Line End indicator 322 can be positioned in any location near the corresponding reels. For example, the Line Start indicator 320 can alternatively be positioned below the first reel 302*a*. Optionally, when the Select Line button 304 is pressed and Reel Set 1 is selected, an animation of the Line Start indicator 320 and/or the Line End indicator 322 is used to show the order of reels or symbols for the selected reels set. An example of such animation is described below in reference to FIGS. 8*a*-8*e*.

The game screen 300 further includes a Win indicator 324, which is positioned below the reels 302*a*-302*e*. The Win indicator 324 indicates in a clear and simple manner to the player the amount of credits won and the number of winning paylines. Optionally, the Win indicator 324 can provide more or less information regarding the player's winnings. For example, the Win indicator 324 can identify the specific winning paylines (e.g., "WIN OF 100 ON 3 WINNING PAYLINES—LINE 1, LINE 5, AND LINE 10").

Figure 4:
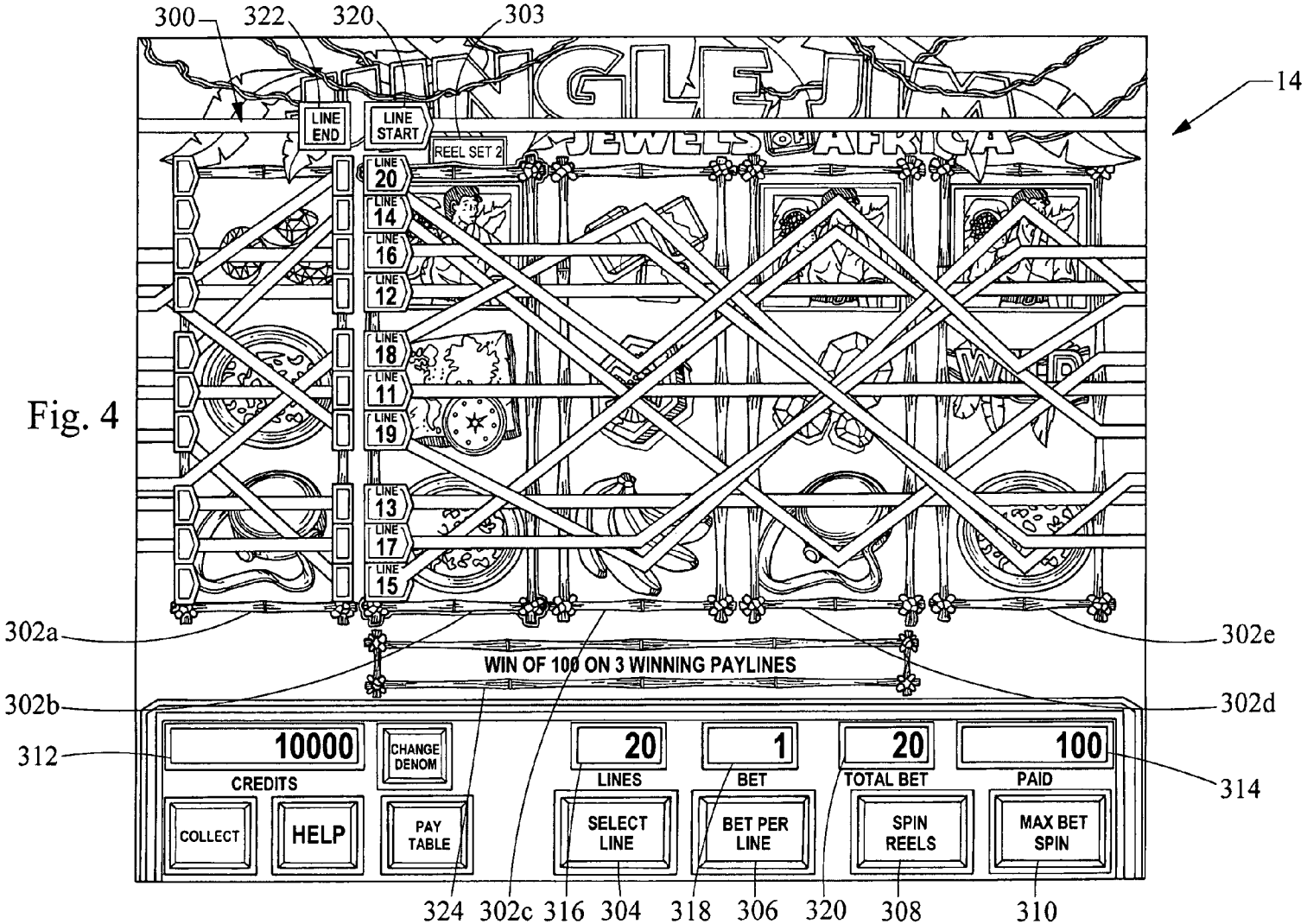
FIG. 4 is a representation of a game screen having twenty active paylines, according to an alternative embodiment of the present invention.

Referring to FIG. 4, the game screen 300 now shows a Reel Set 2 that includes twenty paylines. The twenty paylines include the previously shown paylines Line 1-Line 10 (shown in FIG. 3) and new paylines Line 11-Line 20 shown in FIG. 4. Alternatively, Reel Set 2 may include only the ten new paylines, Line 11-Line 20.

In contrast to the traditional paylines of Reel Set 1, the new paylines included in Reel Set 2 wrap around from the fifth reel 302*e* to the first reel 302*a*. Specifically, the wrap-around paylines Line 11-Line 20 start at the second reel 302*b*, continue beyond the fifth reel 302*e*, and end at the first reel 302*a*. Although the fifth reel 302*e* and the first reel 302*a* are represented as being physically separate from each other, the new paylines of Reel Set 2 are continuous between the fifth reel 302*e* and the first reel 302*a* as if the reels were adjacent to each other.

Adding Reel Set 2 to the gameplay allows a player the opportunity to wager on a larger number of paylines than traditionally available, without modifying the number of reels. Thus, a player conducting a wagering game on a traditional gaming machine can wager on a larger number of reels than traditionally available, wherein only slight modifications are implemented to the gaming machine. Further, the player has a perceived notion of an increased chance of winning because he or she can wager on a relatively larger number of paylines—i.e., the more paylines the more possible ways for symbols to line up to create a win.

The reel set indicator 303 is now positioned above the second reel 302*b* to indicate the currently selected, Reel Set 2. The Line Start indicator 320 is positioned above the second reel 302*b* to indicate to the player that wrap-around paylines Line 11-Line 20 of Reel Set 2 begin at the second reel 302*b*, and the Line End indicator 322 is positioned above the first reel 302*a* to indicate to the player that the wrap-around paylines Line 11-Line 20 end at the first reel 302*a*. The continuous line between the Line Start indicator 320 and the Line End indicator 322 depicts the wrap-around feature of Reel Set 2. For ease of understanding, the original paylines Line 1-Line 10 are not shown even though according to the present embodiment they are included in Reel Set 2.

The starting point of each wrap-around payline is shown positioned in a corresponding position on the second reel 302*b*. The lines corresponding to each wrap-around payline continue through and end at the first reel 302*a*. Thus, similar to the line connecting the Line Start indicator 320 and the Line End indicator 322, the lines corresponding to the wrap-around paylines depict the continuity between the fifth reel 302*e* and the first reel 302*a*.

The Lines indicator 316 now shows that the number of lines selected is 20. Because the wager per line is 1 credit (as shown by the Bet indicator 318), the total number of wagered credits is 20 (as shown by the Total Bet indicator 320). The player can increase the number of selected paylines by optionally pressing the Select Line button 304. One press of the Select Line button 304 changes the selected paylines from Reel Set 1 to Reel Set 2.

Figure 5:
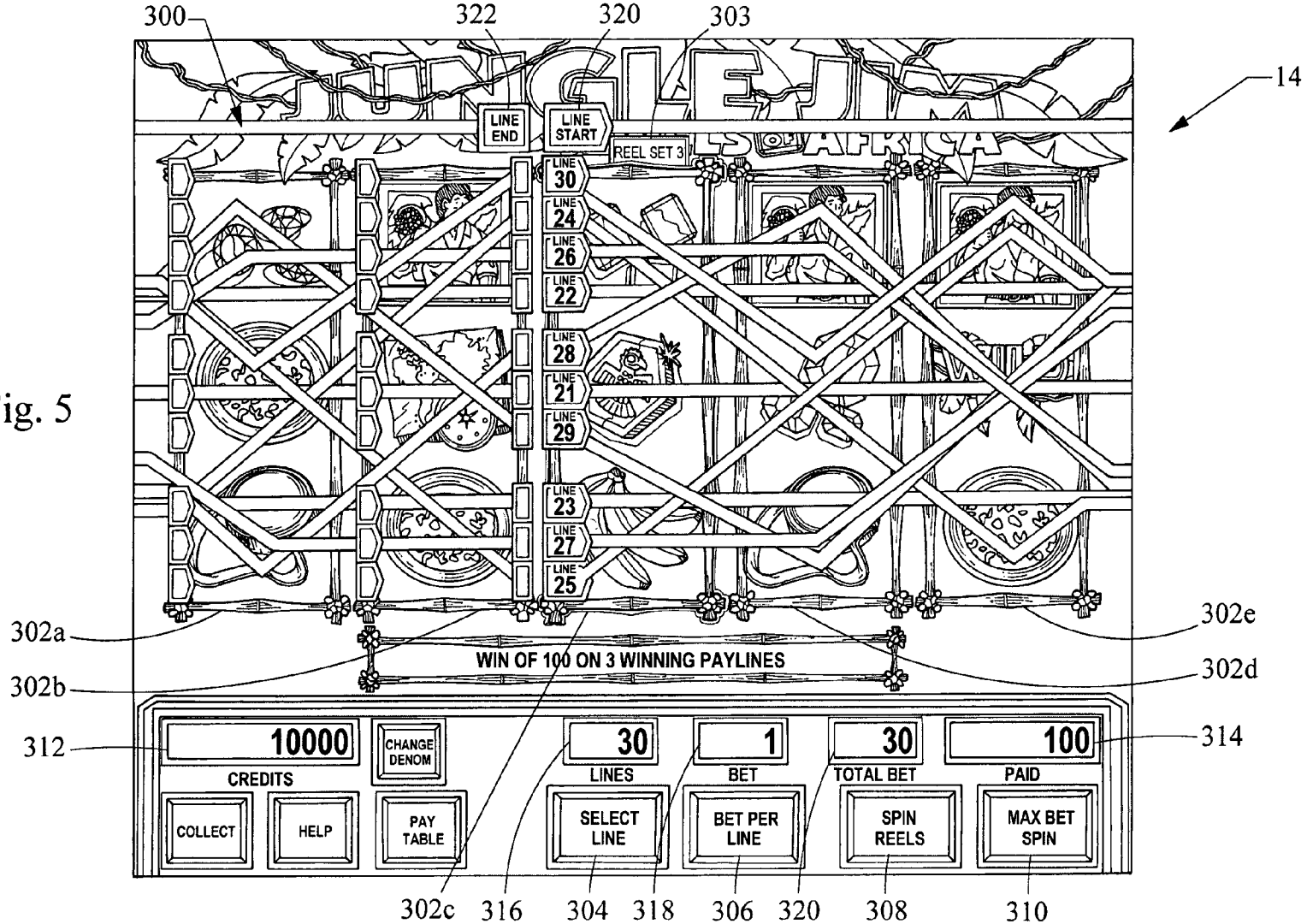
FIG. 5 is a representation of a game screen having thirty active paylines, according to an alternative embodiment of the present invention.

Referring to FIG. 5, the game screen 300 now shows a Reel Set 3 that includes thirty paylines. The thirty paylines include the previously shown paylines Line 1-Line 20 (shown in FIGS. 3 and 4) and new wrap-around paylines Line 21-Line 30. Alternatively, Reel Set 3 may include only the added wrap-around paylines, Line 21-Line 30, or only the wrap-around paylines, Line 11-Line 30.

Wrap-around paylines Line 21-Line 30 begin at the third reel 302*c* and end at the second reel 302*b*. In general, the wrap-around paylines Line 21-Line 30 are similar to the wrap-around paylines Line 11-Line 20 except that they begin and end at different reels than the wrap-around paylines Line 11-Line 20. The Line Start indicator 320 is now positioned next to the third reel 302*c* and the Line End indicator 322 is now positioned next to the second reel 302*b*. The Lines indicator 316 shows that the number of selected paylines is 30, with the total wager being 30 credits (shown in the Total Bet indicator 320).

Figure 6:
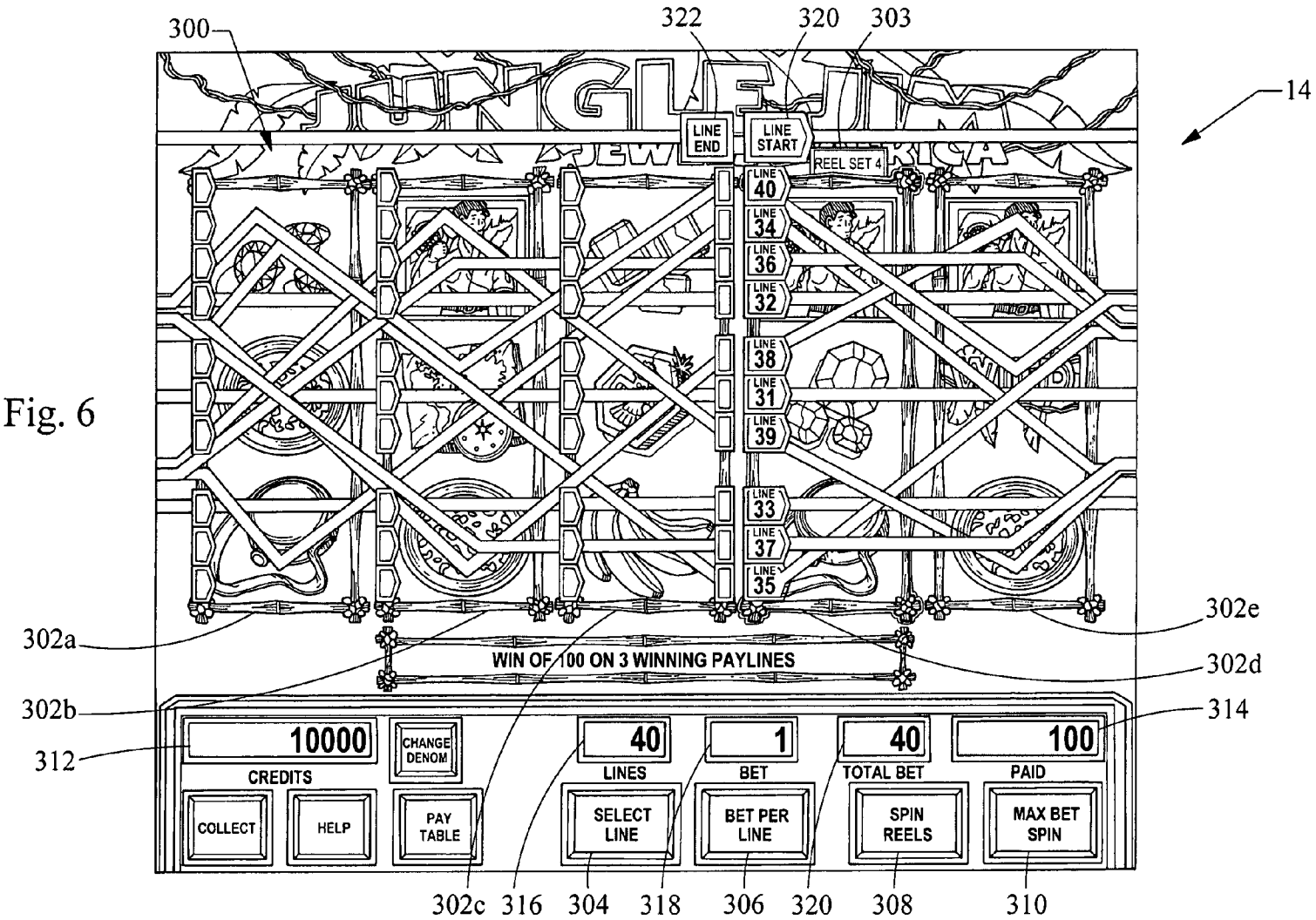
FIG. 6 is a representation of a game screen having forty active paylines, according to an alternative embodiment of the present invention.

Referring to FIG. 6, the game screen 300 shows a Reel Set 4 that includes forty paylines. The added paylines are wrap-around paylines Line 31-Line 40, which begin at the fourth reel 302*d* and end at the third reel 302*c*. Paylines Line 31-Line 40 are similar to the previously described wrap-around paylines except that they start at the fourth reel 302*d* and end at the third reel 302*c*.

Figure 7:
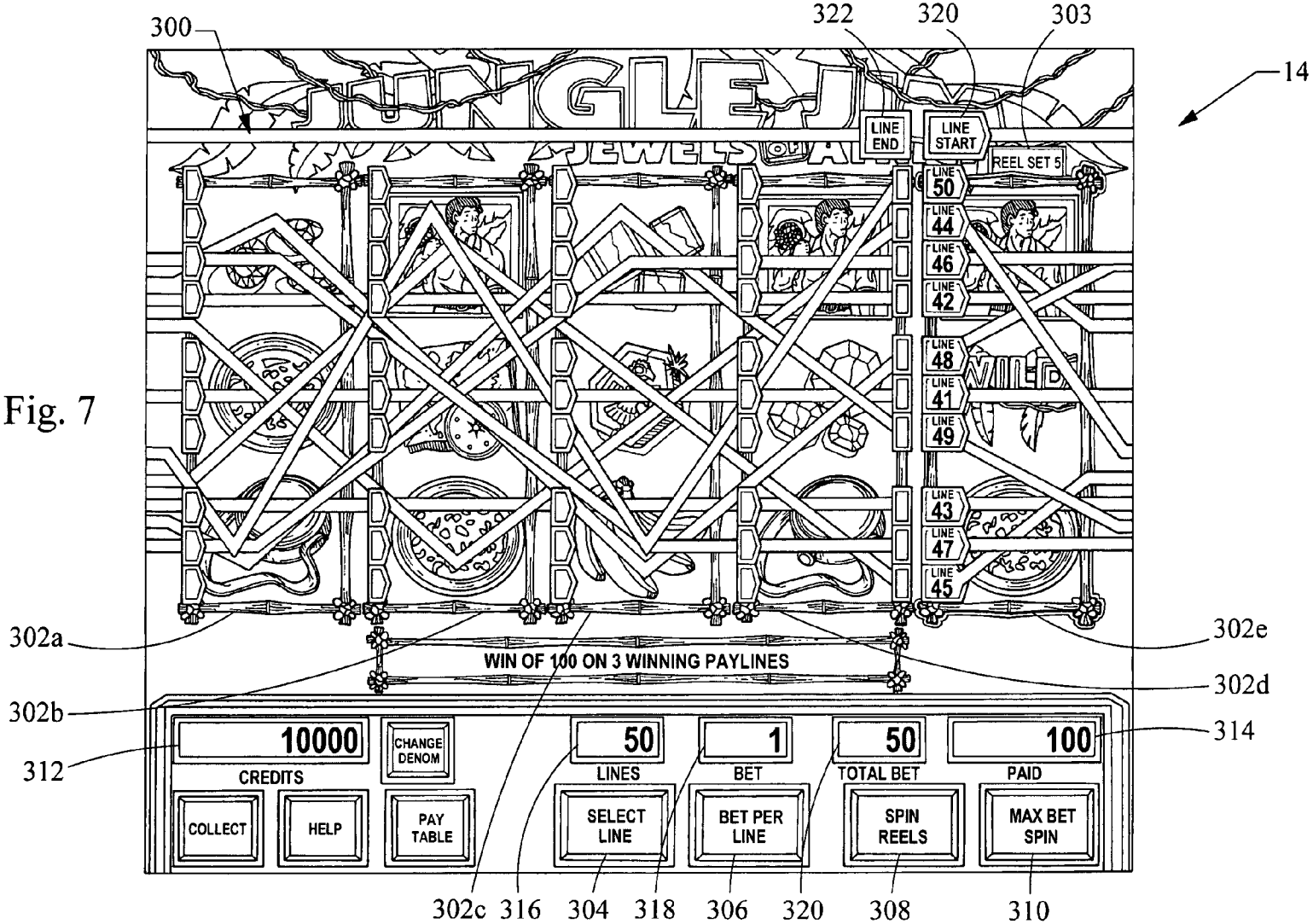
FIG. 7 is a representation of a game screen having fifty active paylines, according to an alternative embodiment of the present invention.

Referring to FIG. 7, the game screen 300 shows a Reel Set 5 that includes fifty paylines. The added paylines are wrap-around paylines Line 41-Line 50, which begin at the fifth reel 302*e* and end at the fourth reel 302*d*. Paylines Line 41-Line 50 are similar to the previously described wrap-around paylines except that they start at the fifth reel 302*e* and end at the fourth reel 302*d*.

Alternatively, wrap-around paylines begin at any reel and end at any reel. For example, referring to wrap-around payline Line 50, the payline can start at the fifth reel 302*e* and end at the second reel 302*b*. Thus, it is not necessary to have the paylines extend across all reels.

Alternatively yet, wrap-around paylines do not have to include adjacent paylines. For example, still referring to wrap-around payline Line 50, the payline can start at the fifth reel 302*e*, extend through the first reel 302*a*, skip the second reel 302*b*, and end at the third reel 302*c*. Thus, in this example, the wrap-around payline does not extend across all the available reels and does not include all adjacent reels. Similarly, in another example the wrap-around payline Line 50 can wrap-around from the fifth reel 302*e* to the second reel 302*b*, without including the first reel 302*a*.

In general, a wager is associated with each selected payline. Optionally, each reel set can have an associated reel set multiplier that is awarded in a default or random manner. For example, winning paylines of Reel Set 2 can be awarded a reel set multiplier of 2×, while winning paylines of Reel Set 3 can be awarded a reel set multiplier of 3×. Thus, the player is given an incentive to spend more money by selecting a higher number of paylines, wherein Reel Set 3 includes ten more paylines than Reel Set 2. The reel set multiplier can be displayed above a beginning reel and can change from spin to spin. For example, the reel set multiplier for Reel Set 3 can be displayed above the third reel 302*c*.

Referring to FIGS. 8*a*-8*e*, the wrap-around paylines Line 11-Line 20 of Reel Set 2 are shown as they extend across from the second reel 302*b* to the first reel 302*a*. To more clearly identify to the player the wrap-around paylines of Reel Set 2, several graphical representations are used. As described in more detail below, the line connecting the Line Start indicator 320 and the Line End indicator 322 is animated above the reels to show which reel set of paylines has been selected. Similarly, the selected paylines and the reels of the selected paylines are highlighted to show which reel positions are being used for each set of paylines.

Referring to FIGS. 8*a*-8*e*, the reels 302*b*, 302*c*, 302*d*, 302*e*, and 302*a* are sequentially emphasized in the foregoing order to indicate the progression of wrap-around paylines Line 11-Line 20 of Reel Set 2. As each reel is emphasized, the position of Line End indicator 320 is repositioned above the latest emphasized reel.

Figure 8A:
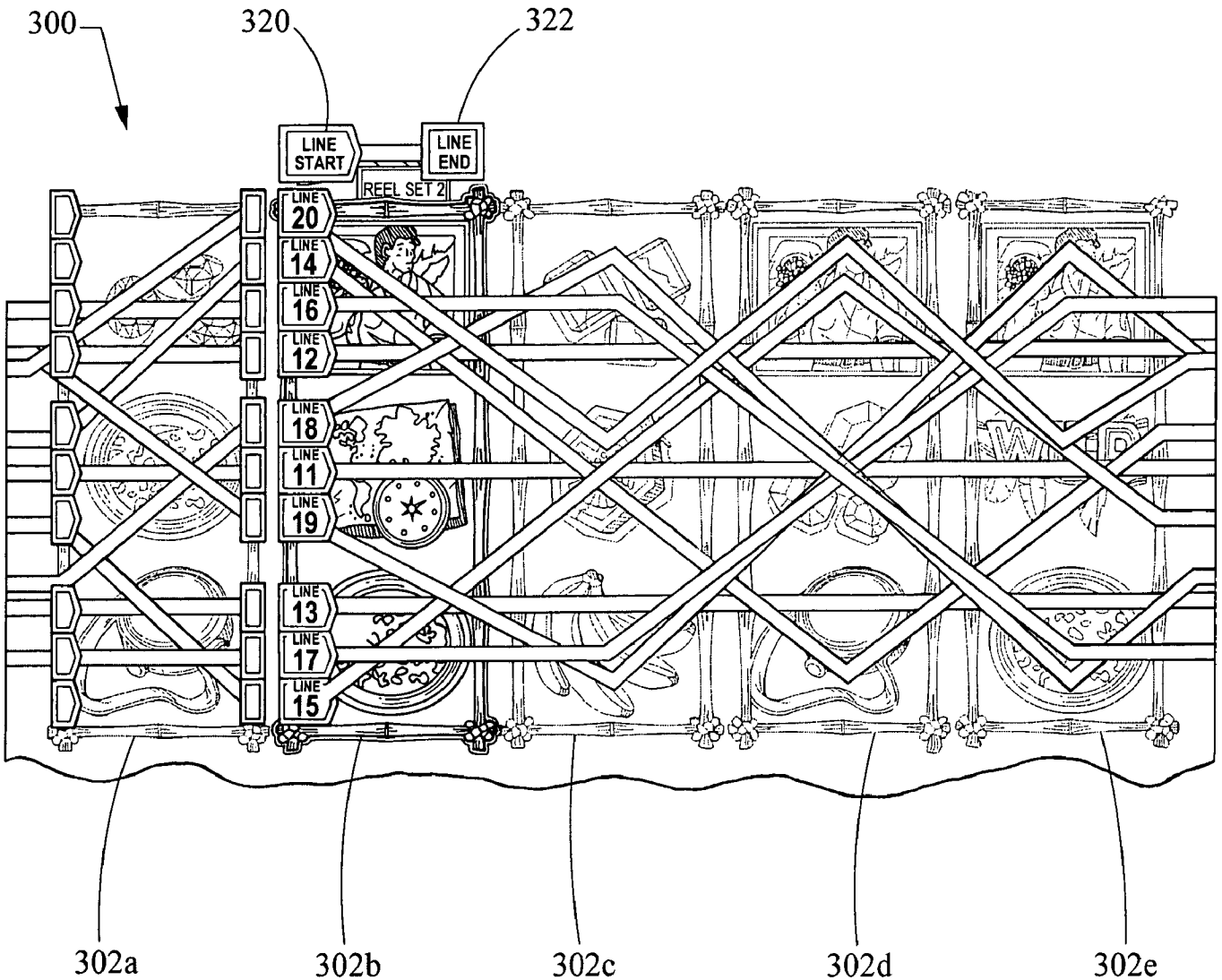
FIGS. 8*a*-8*e* are representative game screens showing an active payline extending across a plurality of reels.

Referring to FIG. 8*a*, when the player selects Reel Set 2 the symbols of the second reel 302*b* are shown emphasized while the symbols of the other reels 302*c*, 302*d*, 302*e*, and 302*a* are shown deemphasized. For example, the symbols of the reels 302*c*, 302*d*, 302*e*, and 302*a* are shown deemphasized by showing them grayed-out. Thus, the player is made visually aware that the paylines of Reel Set 2 begin at the second reel 302*b*. To further clarify the reels included in the wrap-around paylines of Reel Set 2, the Line Start indicator 320 and the Line End indicator 322 are both shown above the second reel 302*b*.

Figure 8B:
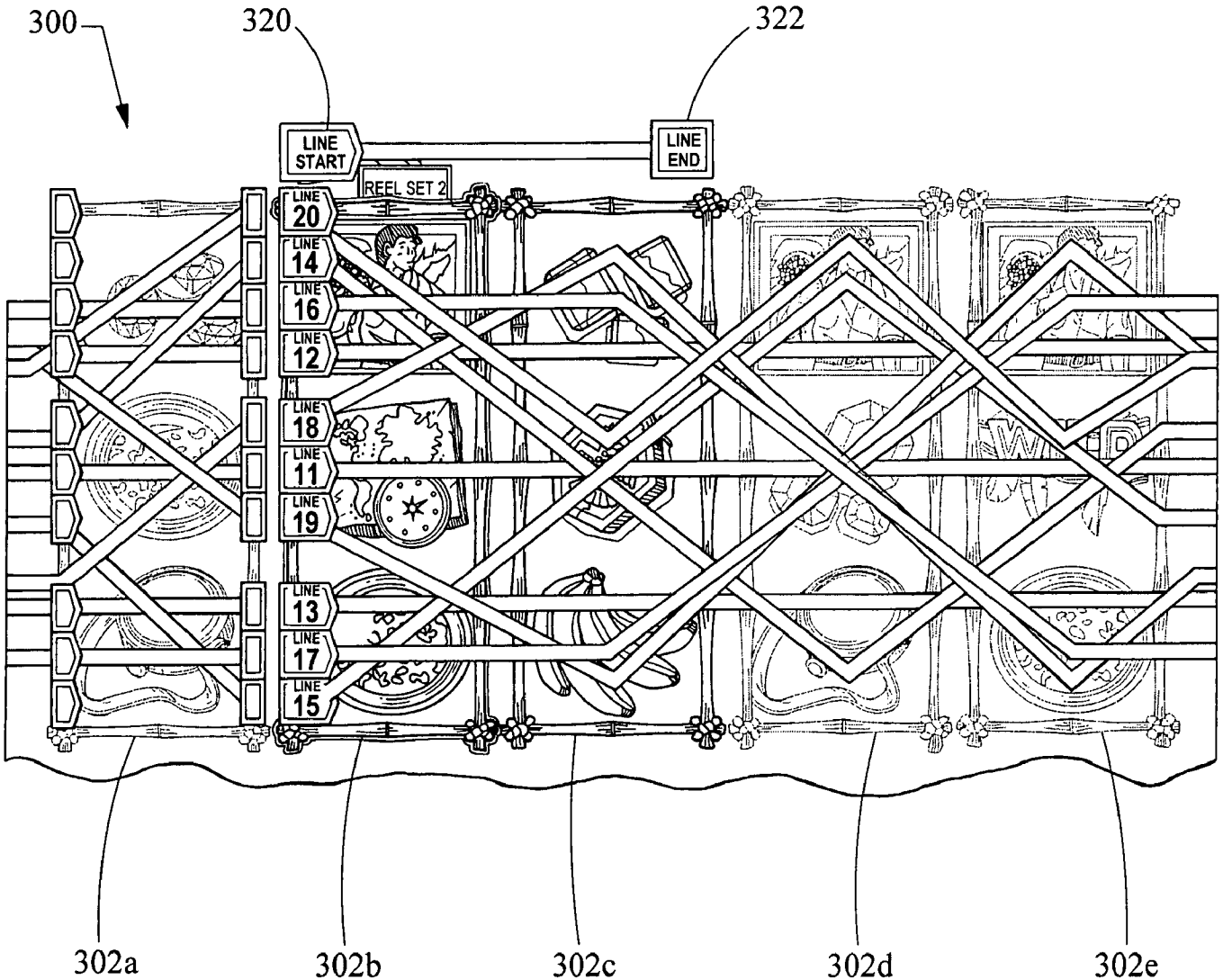

Referring to FIG. 8*b*, the progression of the wrap-around paylines Line 11-Line 20 is represented by emphasizing the next reel, the third reel 302*c*. The second reel 302*b* (which is the beginning reel) and the third reel 302*c* (which is the adjacent reel of the beginning reel) are the only reels that are emphasized. In addition, the Line End indicator 322 is shown above the third reel 302*c*.

Figure 8C:
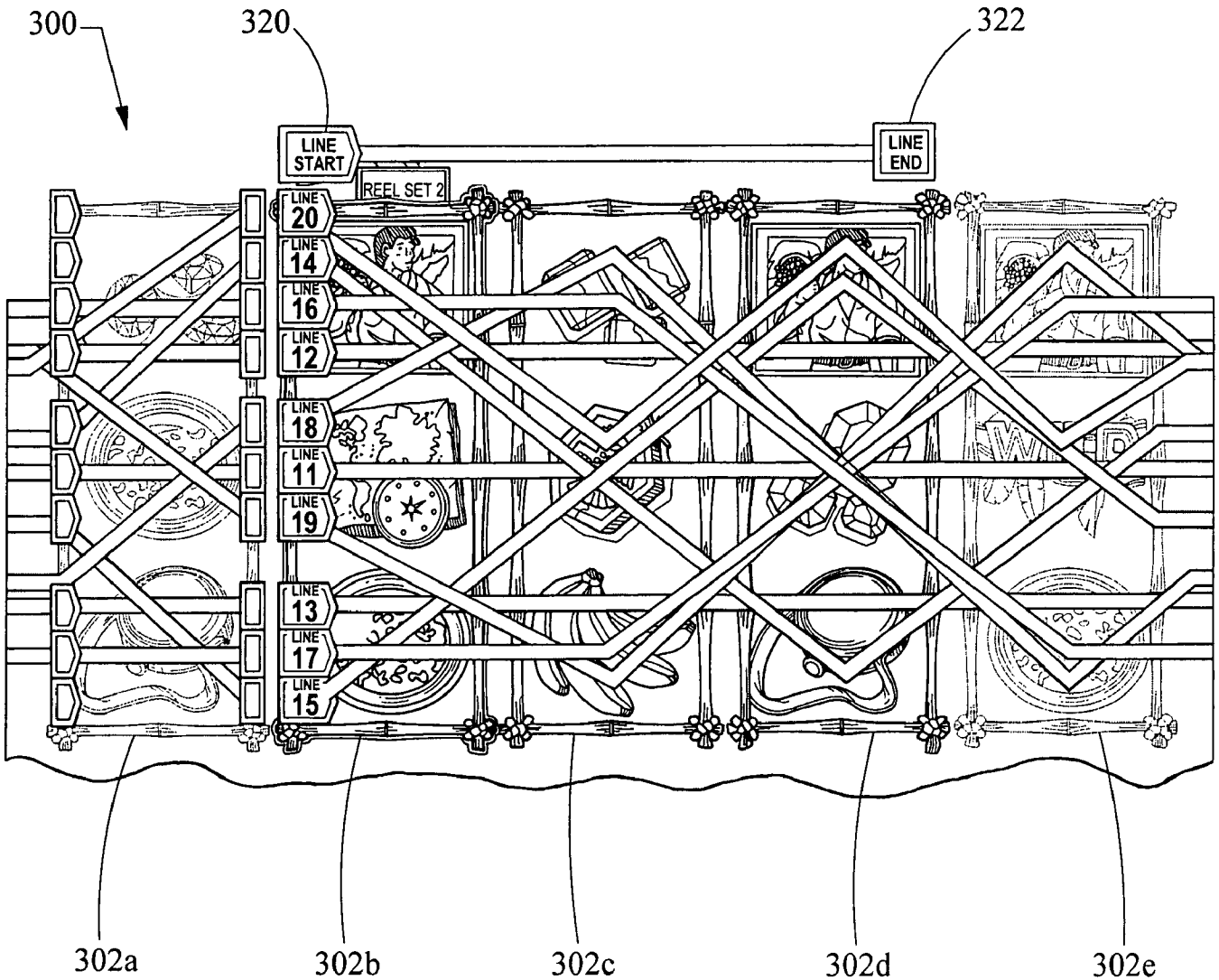

Referring to FIG. 8*c*, the progression of the wrap-around paylines Line 11-Line 20 is extended to the next reel, the fourth reel 302*d*. The second reel 302*b*, the third reel 302*c*, and the fourth reel 302*d* are the only reels that are emphasized. In addition, the Line End indicator 322 is shown above the fourth reel 302*d*.

Figure 8D:
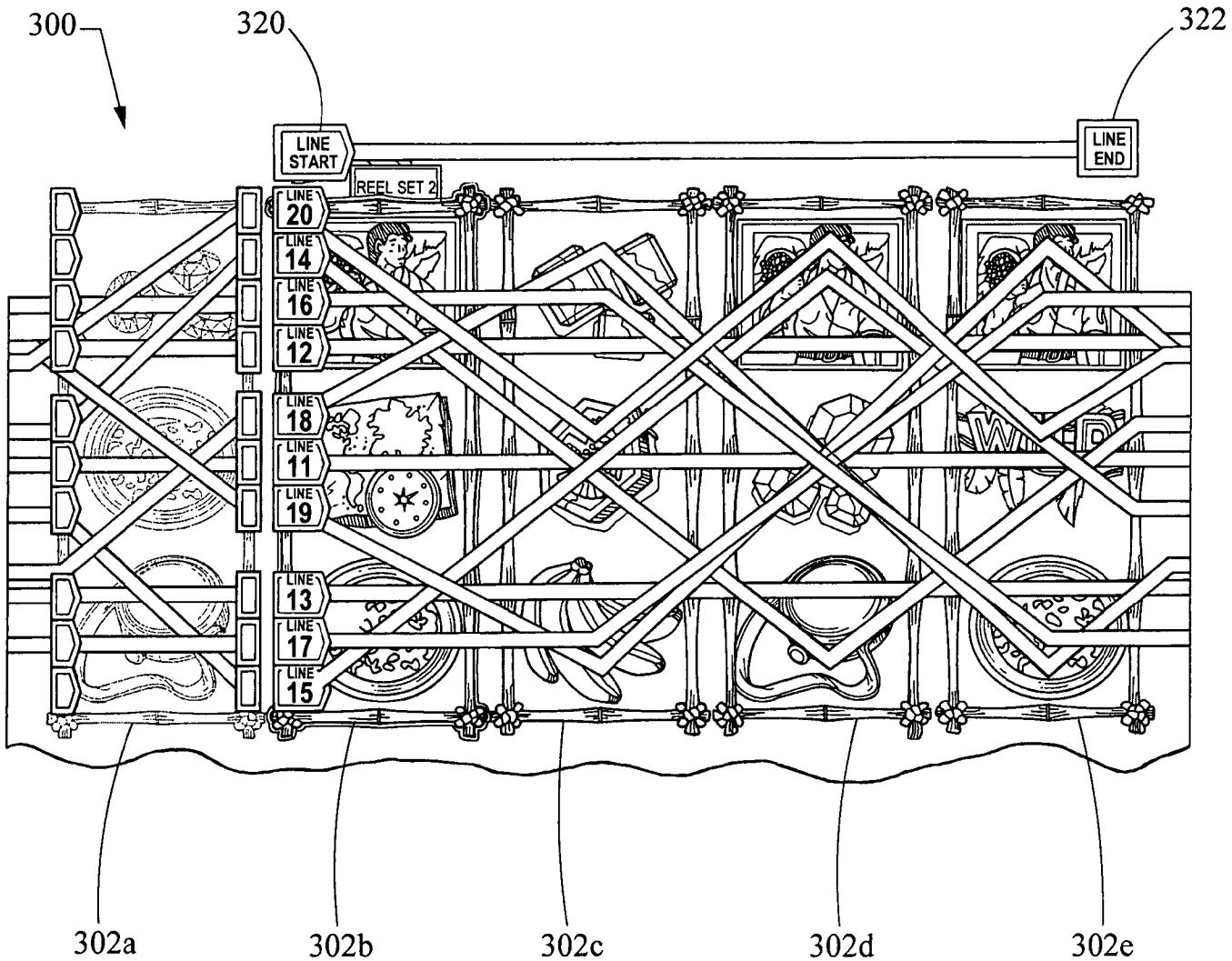

Referring to FIG. 8*d*, the progression of the wrap-around paylines Line 11-Line 20 is extended to the next reel, the fifth reel 302*e*. All reels except the first reel 302*a* are shown emphasized. In addition, the Line End indicator 322 is shown above the fifth reel 302*e*.

Figure 8E:
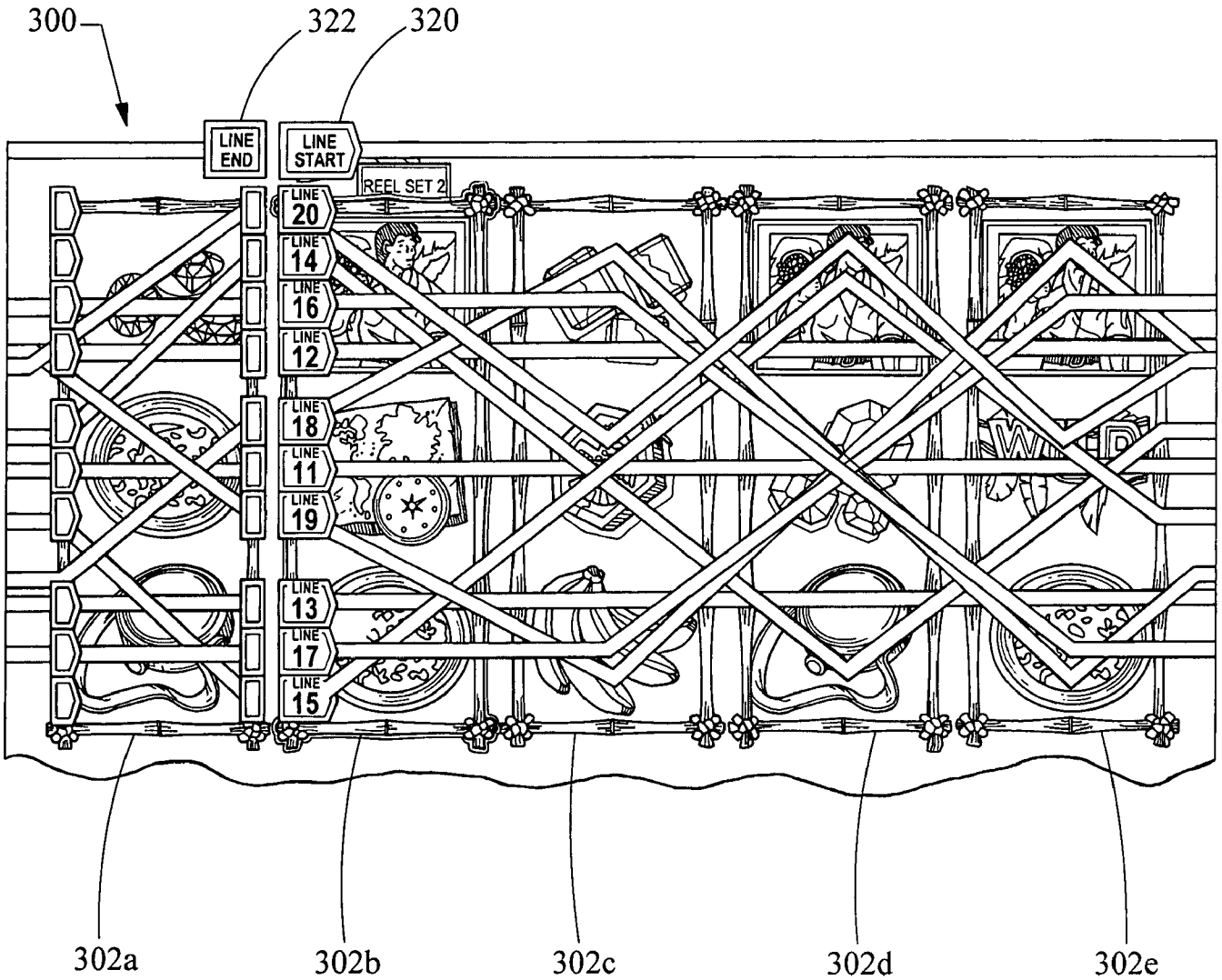

Referring to FIG. 8*e*, the progression of the wrap-around paylines Line 11-Line 20 is now shown complete. All reels are shown emphasized and the Line End indicator 322 is shown above the first reel 302*a*.

The progression of the wrap-around paylines Line 11-Line 20 is generally an animation that visually identifies to the player the newly added wrap-around paylines. Optionally, the lines identifying each individual wrap-around payline can also be shown progressing through each reel. Alternatively, the progression across each reel includes associated sounds, which optionally culminate at the last reel. For example, the sounds get louder with each reel such that the loudest sound is provided in the last reel (i.e., the first reel 302*a*).

Referring to FIGS. 9*a*-9*e*, a progression of a winning payline is represented as it extends across the reels. To better identify winning paylines, each winning payline is progressively displayed after the reels have stopped spinning. Specifically, each winning payline is shown extending across each reel—one at a time—as a visual aid to the player. Another visual aid for identifying a winning payline includes emphasizing the reels one at a time.

Figure 9A:
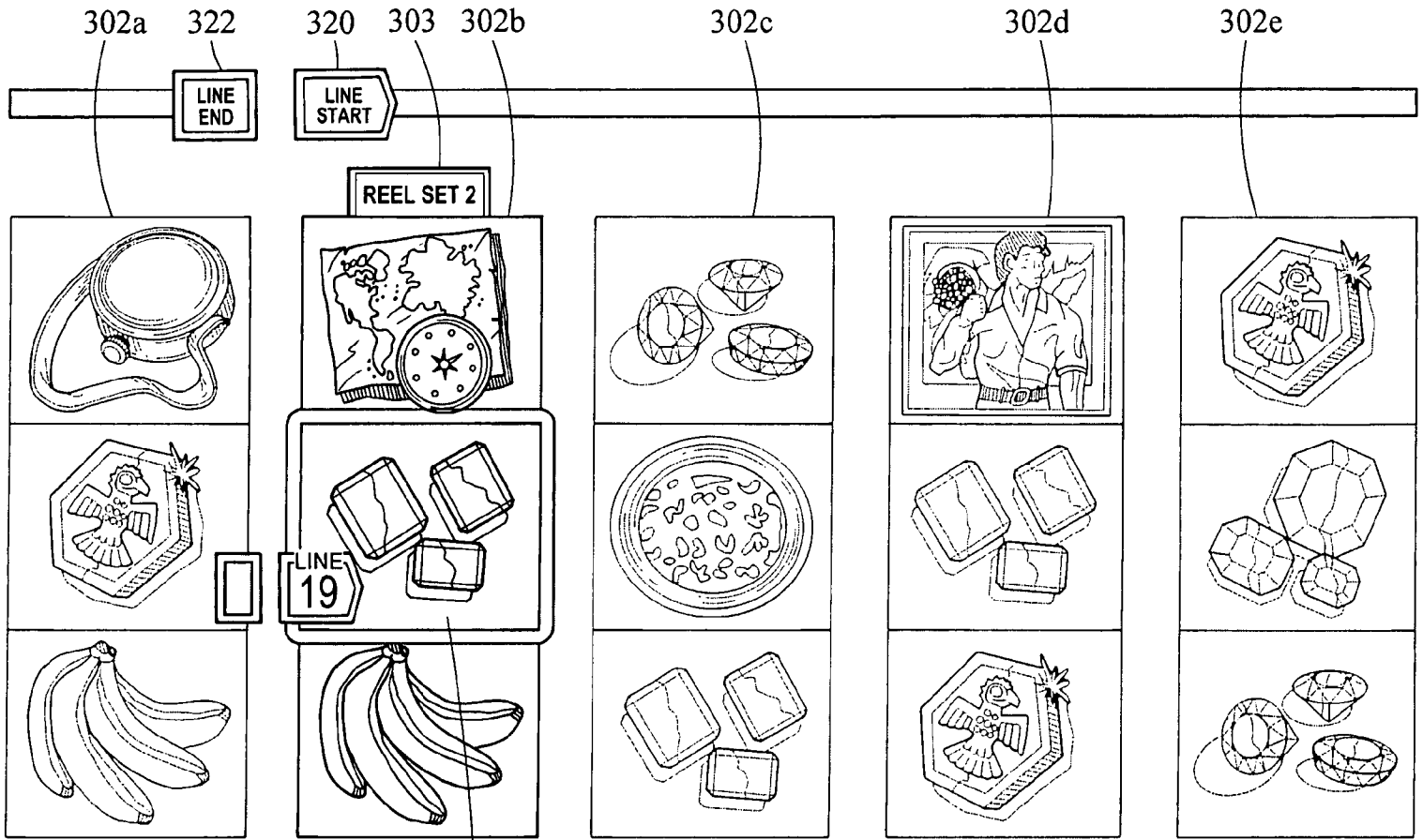
FIGS. 9*a*-9*e* are representative game screens showing a winning combination on an active payline, according to an alternative embodiment of the present invention.

Referring to FIG. 9*a*, the wrap-around payline Line 19 is shown as an exemplary winning payline. Initially, after achieving a winning payline, all the reels are deemphasized (e.g., grayed-out). Then, as shown, a first winning symbol 900 is emphasized using a generally rectangular box. The first winning symbol 900 is located in the second reel 302*b*, which is the beginning reel of the wrap-around payline Line 19. Thus, initially only a corresponding winning symbol of the beginning reel is shown emphasized in some manner. In addition, all the reels except the beginning reel 302*b* are deemphasized (e.g., grayed-out). Optionally, the reel set indicator 303 pops up to indicate that the winning payline is part of Reel Set 2.

Figure 9B:
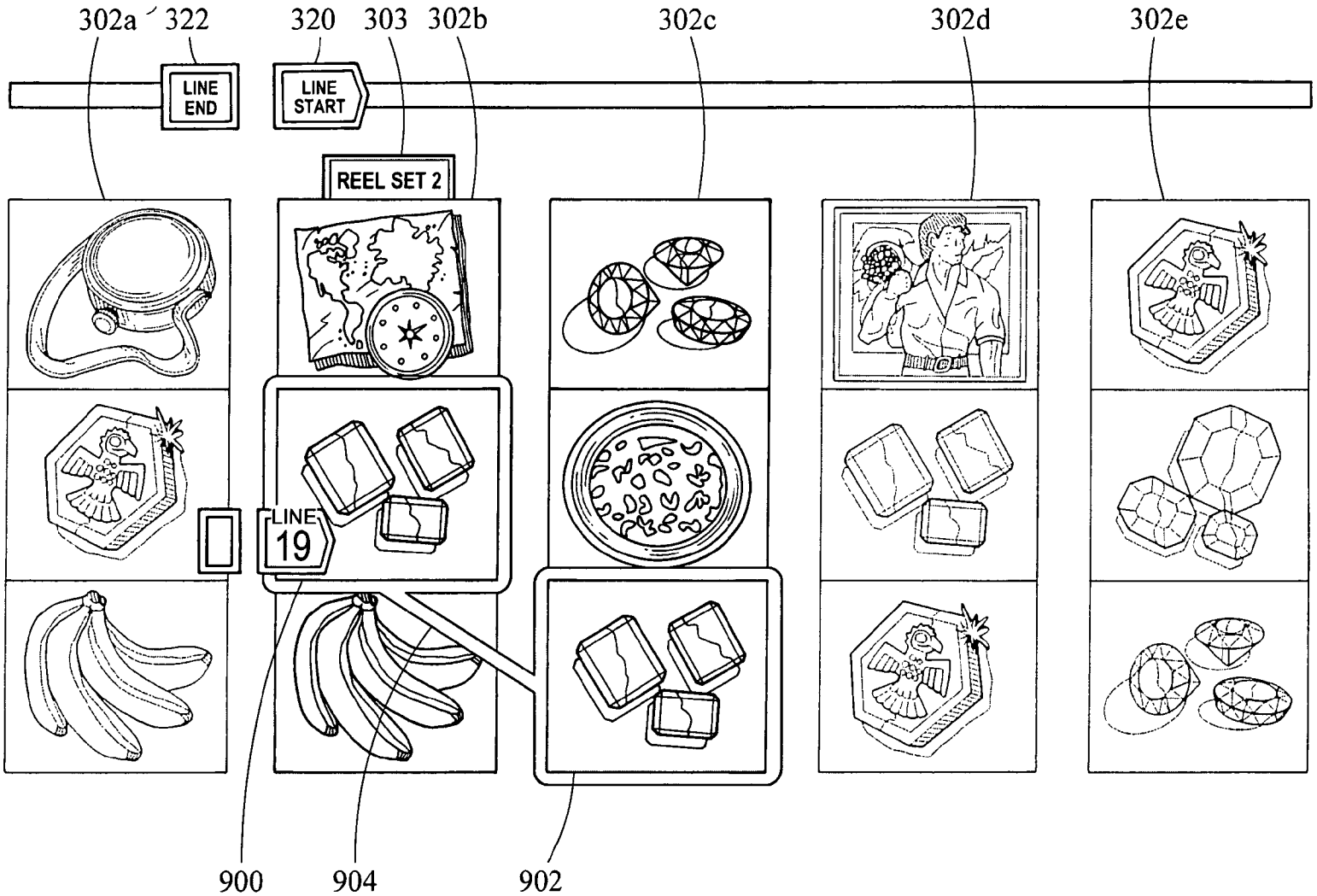

Referring to FIG. 9*b*, a second winning symbol 902 is emphasized in the third reel 302*c*. The progression so far only shows the first winning symbol 900 and the second winning symbol 902, which are connected via a first connecting line 904. In addition, the third reel 302*c* is now shown emphasized (i.e., it is no longer grayed-out).

Figure 9C:
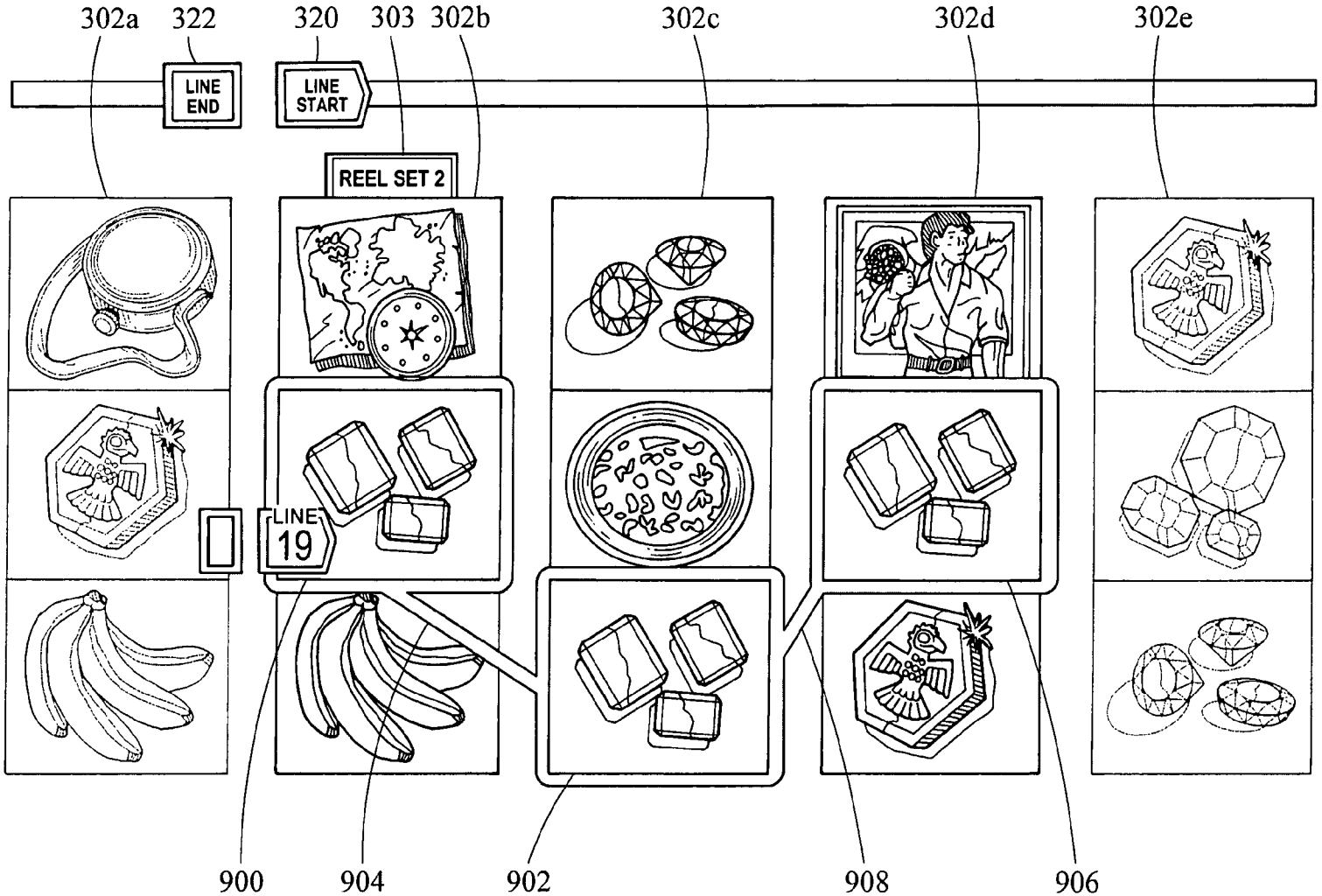

Referring to FIG. 9*c*, a third winning symbol 906 is emphasized in the fourth reel 302*d*. The progression so far shows the first winning symbol 900 connected via the first connecting line 904 to the second winning symbol 902, and the third winning symbol 906 connected via a second connecting line 908 to the second winning symbol 902. In addition, the fourth reel 302*d* is now shown emphasized.

Figure 9D:
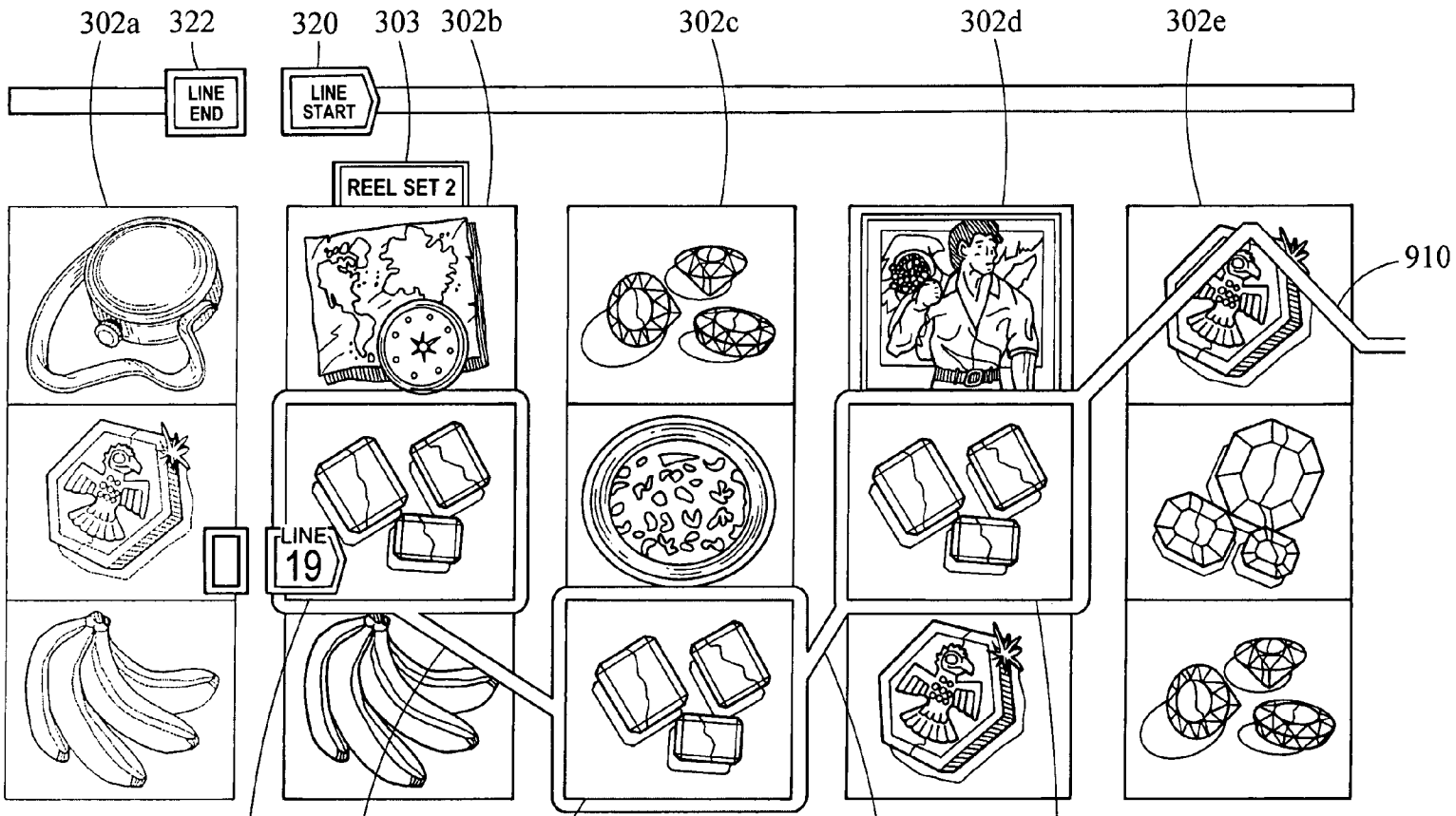

Referring to FIG. 9*d*, a third connecting line 910 is shown to connect the third winning symbol 906 across the fifth reel 302*e*. Because a winning symbol is not located in the fifth reel 302*e*, the third connecting line 910 is generally longer than the first connecting line 904 and the second connecting line 908. The fifth reel 302*e* is now shown emphasized.

Figure 9E:
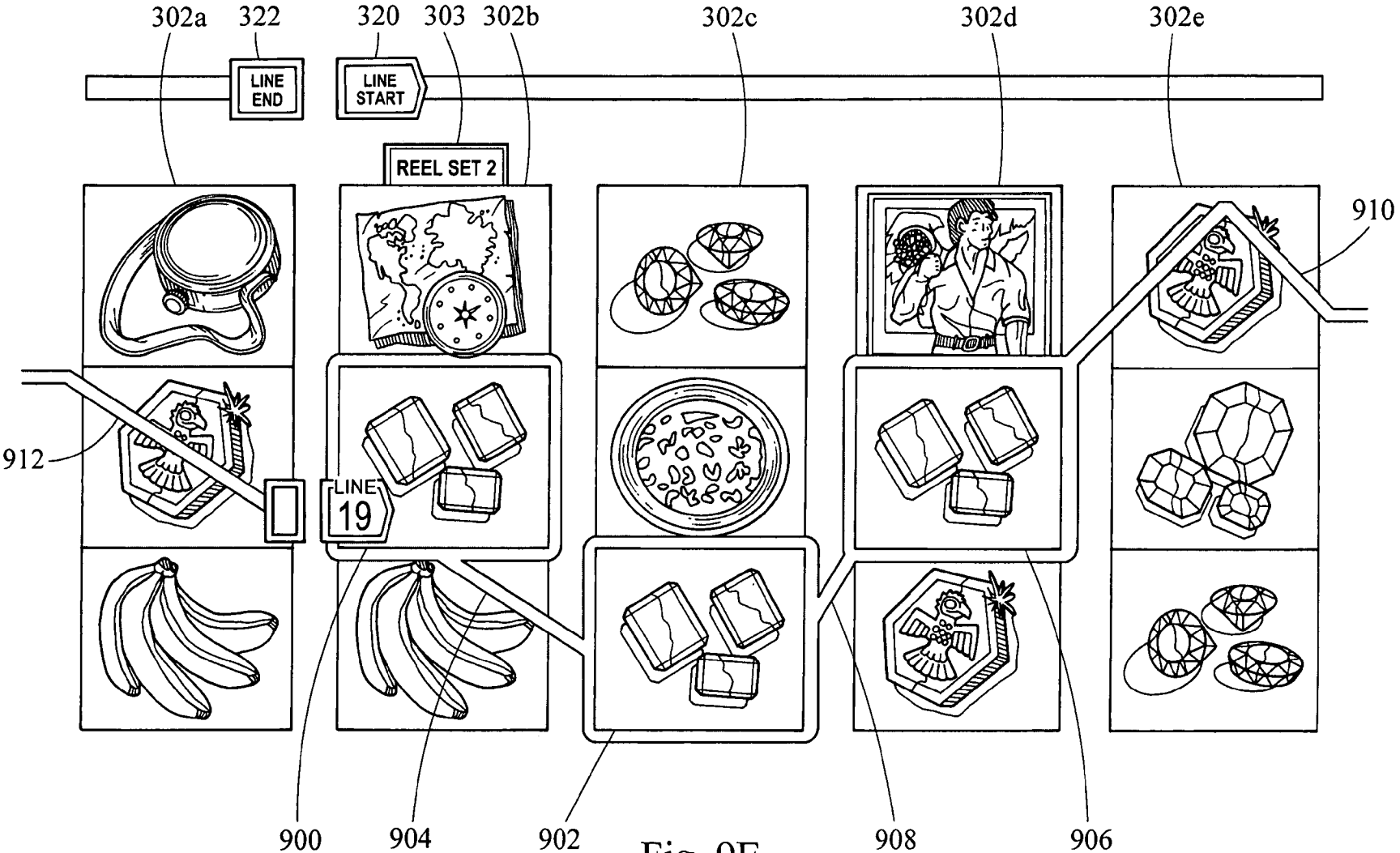

Referring to FIG. 9*e*, a fourth connecting line 912 is shown to connect the third connecting line 910 to the End Line indicator shown in the first reel 302*a*. Similar to the fifth reel 302*e*, there is no winning symbol in the first reel 302*a*. All the reels are now shown emphasized.

Other ways to emphasize/deemphasize reels associated with a winning payline include lighting the reels in sequence, one at a time. The lighting of the reels can, optionally, vary in intensity such that the lighting is more intense at the end reel than at the beginning reel. The emphasis/de-emphasis of the reels can also be used, for example, when at least one winning payline has a left-to-right configuration and at least one winning payline has a right-to-left configuration.

Figure 10A:
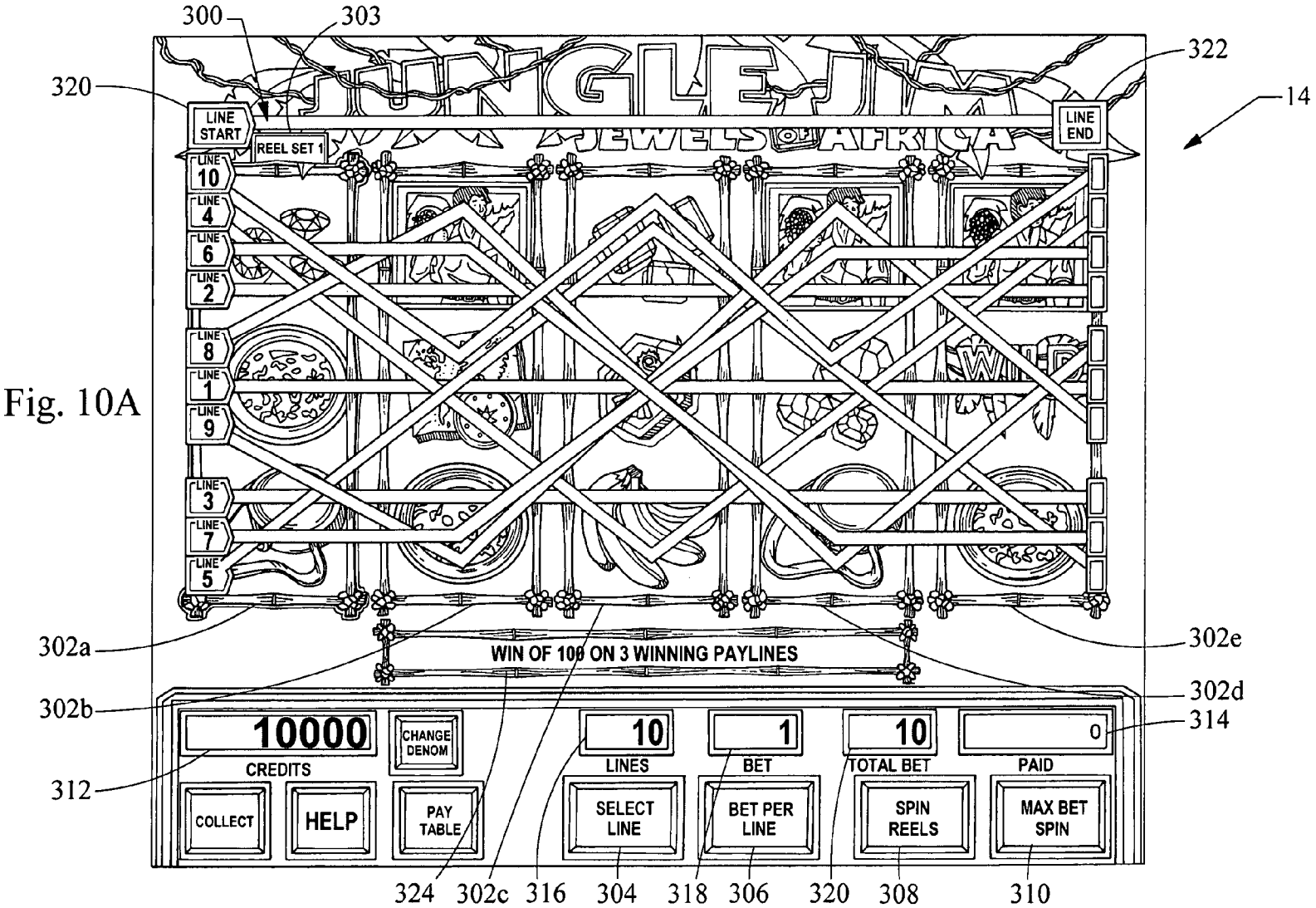
FIGS. 10*a*-10*b* are representative game screens showing changes to increment meter digits, according to an alternative embodiment of the present invention.
Figure 10B:
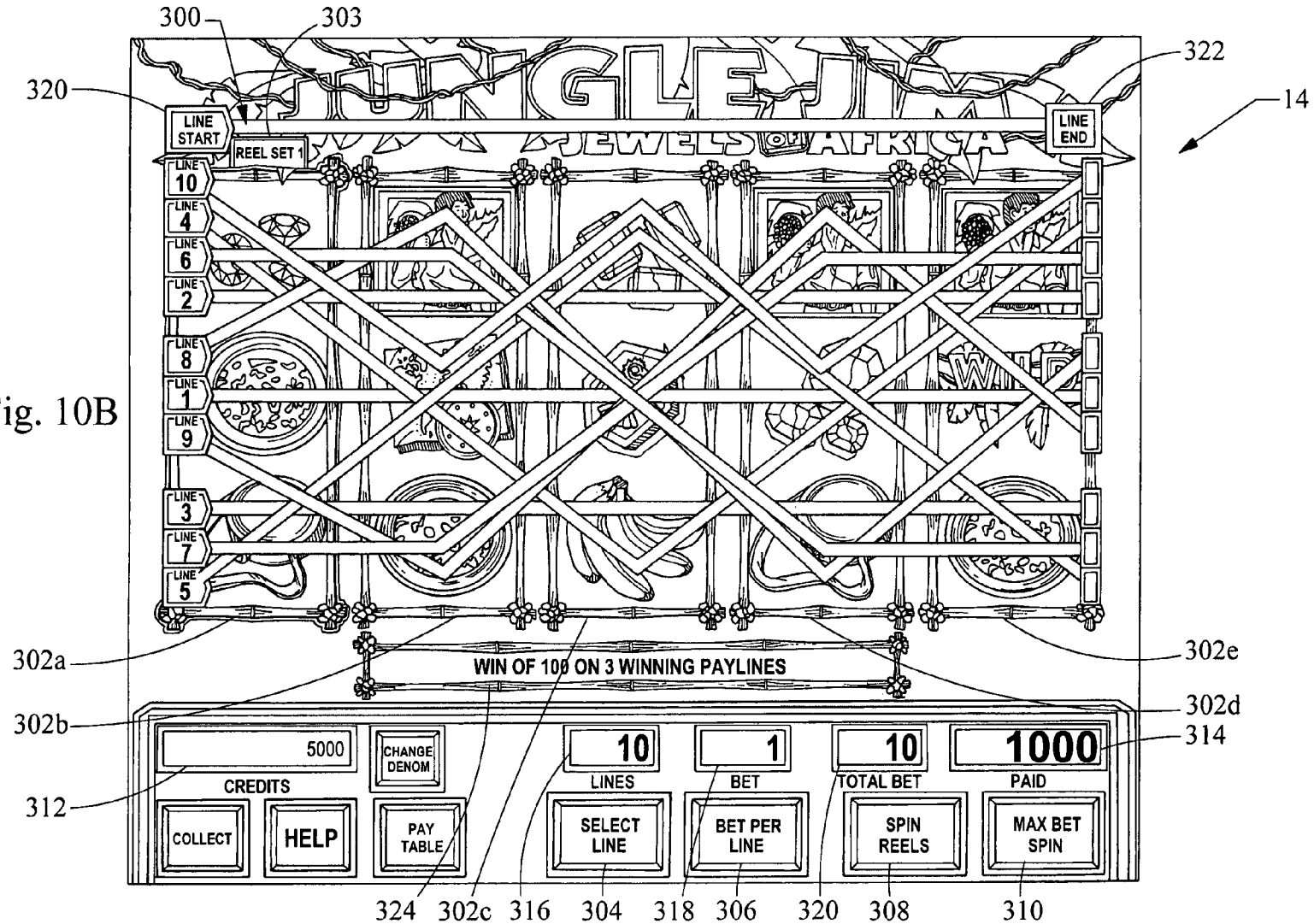

Referring to FIGS. 10*a*-10*b*, various ways are used to show emphasis on a changing meter. The emphasis to the meter draws the player's attention to the change in the meter and provides positive reinforcement to the player during the wins. The emphasis remains until the pay is complete after which the emphasis is removed.

Generally, when a win occurs, the value of meters such as the Credits increment meter 312 and the Paid increment meter 314 changes. One way to show emphasis is to change (or scale) the size of the digits indicator of the Credits increment meter 312 and the Paid increment meter 314 in accordance with a change in meter value. The size change of the digits indicators emphasizes to the player that the meter value has changed. For example, in FIG. 10*a* the value of the Credits increment meter 312 is 10,000 credits. The digits indicator of the 10,000 credits fills the Credits window. Assuming that after several games the player has lost 5,000 credits, the meter value of the Credits increment meter 312 decreases to 5,000 credits. Because the value of the Credits increment meter 312 has decreased, the size of the digits indicator also decreases. Accordingly, referring to FIG. 10*b*, the digits indicator of the Credits increment meter 312 is shown reduced in size.

Similarly, the digits indicator of the Paid Increment meter 314 also changes size. The value associated with the Paid Increment meter 314 increases from 0 credits (shown in FIG. 10*a*) to 1,000 credits (shown in FIG. 10*b*). Because the value increased, the size of the digits indicator of the Paid Increment meter 314 also increases.

Figure 11A:
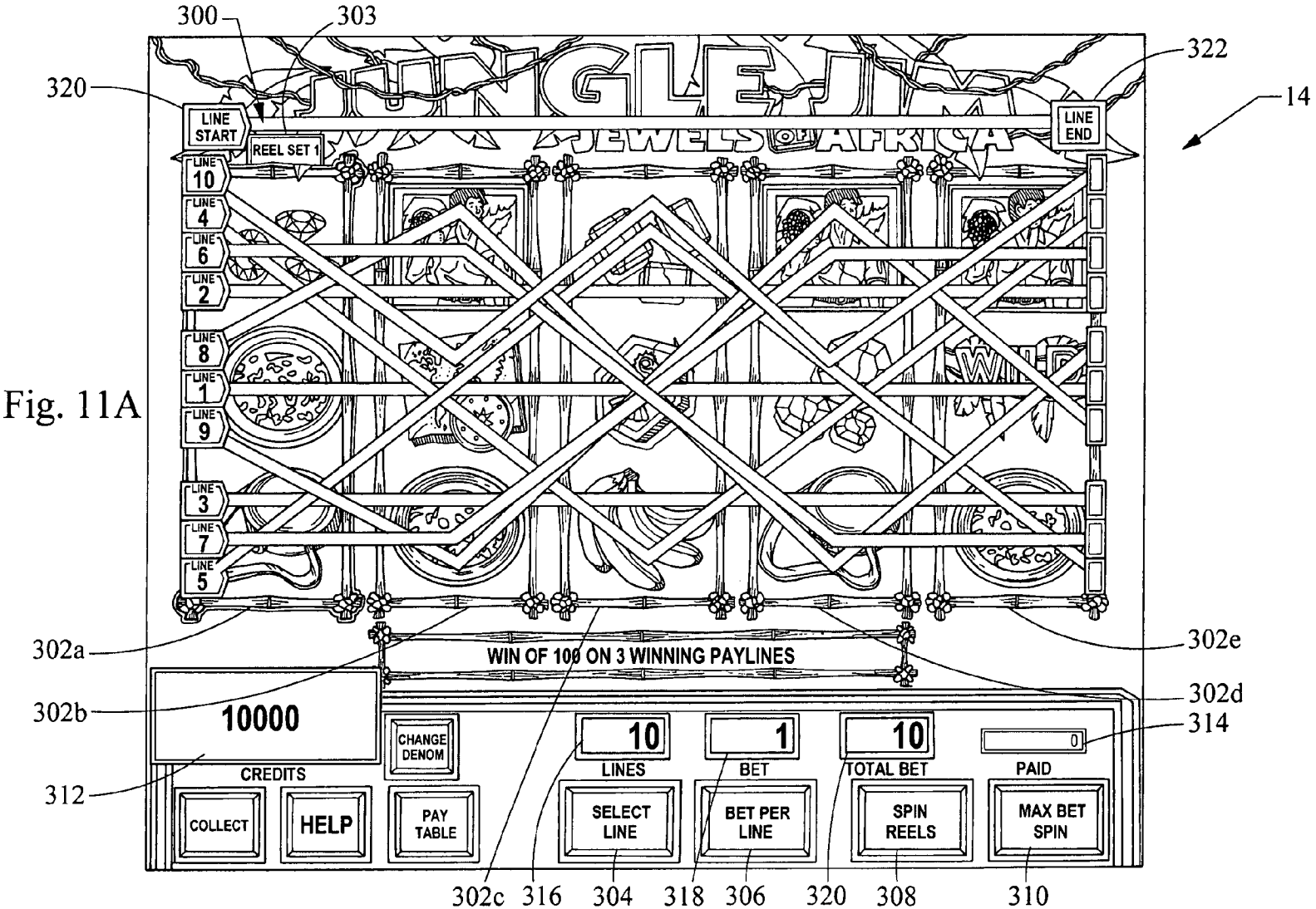
FIGS. 11*a*-11*b* are representative game screens showing changes to an increment meter box, according to an alternative embodiment of the present invention.
Figure 11B:
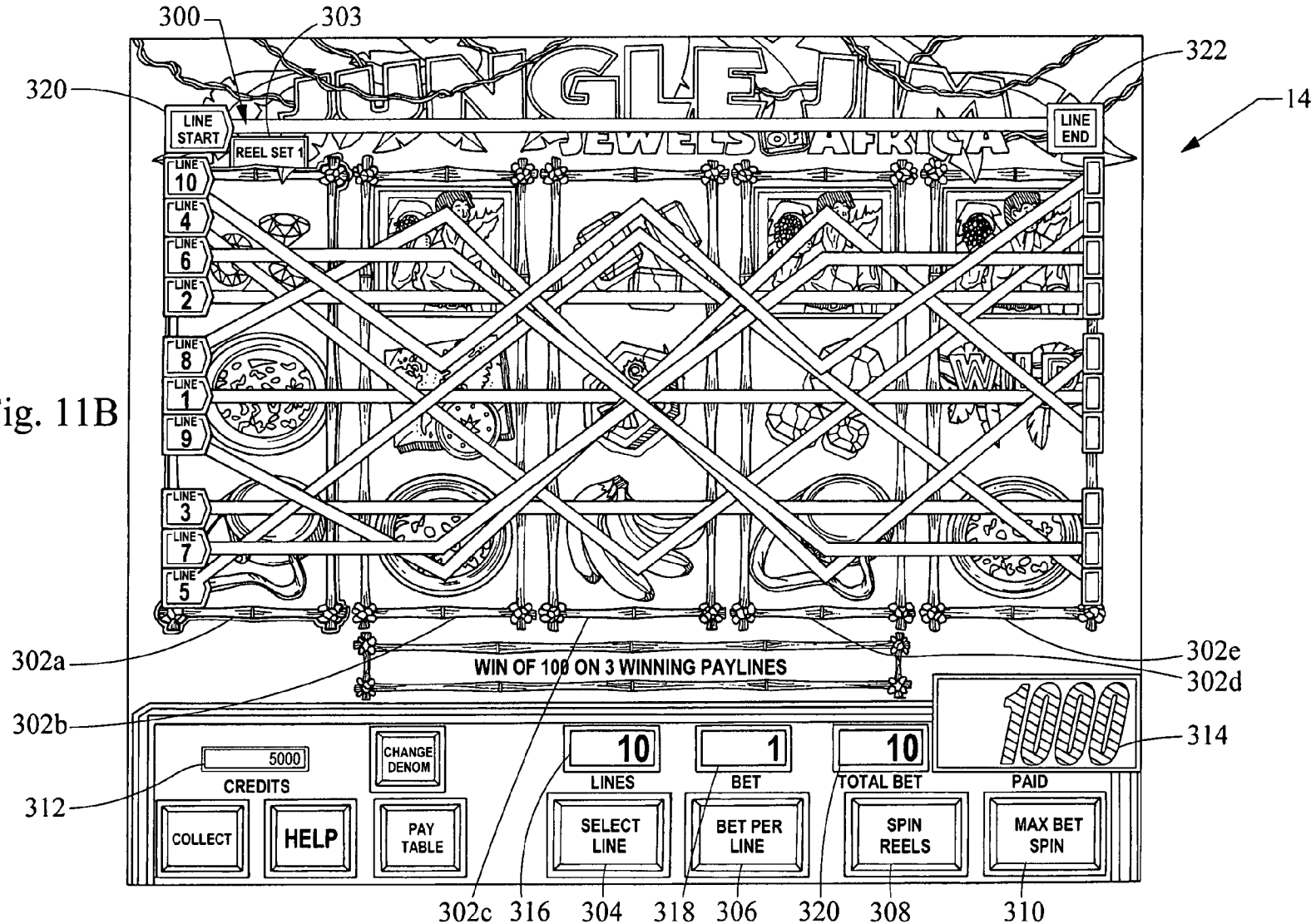

Referring to FIGS. 11*a*-11*b*, other visual changes are used to easily identify to the player changes associated with the value of any of the Credits increment meter 312, the Paid Increment meter 314, or any other meter. For example, referring to FIG. 11*a*, instead of changing the size of the digits indicator, the size of the Credits window for the Credits increment meter 312 is increased to represent the value of 10,000 credits. In contrast, the size of the Paid window of the Paid increment meter 314 is decreased (along with the Paid digits indicator) to represent the value of 0 credits.

In another example, referring to FIG. 11*b*, the texture of the digits indicator is changed based on the value of the associated meter. The Paid digits indicator of the Paid increment meter 314 is changed to show a hatched texture. In addition, the size of the Paid digits and the size of the Paid window is increased to represent the value of 1,000 credits associated with the Paid increment meter 314.

Thus, some of the variables associated with a change in a meter value are the size of the meter digits, the size of the meter window, and the texture of the digits. Other variables include the start and finish color of the meter digits, the start and finish color of the meter window, the typeface of the meter digits, the start and finish color of the background of the meter window, animations, etc.

In another embodiment, changes are made to an increment meter that is displayed on the secondary display 16 or a signage display. For example, changes are made to a progressive sign meter. Thus, the changes described above in reference to FIGS. 10 and 11 can be used on any increment meter and on any display.

Instead or in addition to changing an increment meter based on its associated value, the increment meter is changed based on time. For example, the appearance of a progressive meter is changed when the progressive jackpot increments past a predetermined threshold. One exemplary threshold is a strike price, which is the average value of the progressive jackpot when it is expected to be won. Thus, when the progressive jackpot increments past the strike price, the appearance of the progressive meter changes to indicate that the progressive jackpot has incremented past the amount than its average win. Even though the odds of winning the jackpot does not change, some players may feel that the jackpot is due to hit because it is above its average strike amount. The change in the appearance of the progressive jackpot will likely increase anticipation and potentially create a wagering frenzy among the players.

The appearance of a fixed jackpot can also be changed, even though the fixed jackpot by definition is not associated with an incremental value. For example, the appearance of the fixed jackpot is changed based on how long it has been since the jackpot has been won. In one exemplary embodiment, a fixed jackpot sign changes from a light shade of red to a darker shade of red every day that the fixed jackpot is not won. Thus, the players are made aware visually that the fixed jackpot may be won soon based on the color of the fixed jackpot sign.

In alternative embodiments, visual indicia and/or sounds are used to further increase anticipation associated with particular symbols. For example, while the reels are spinning a visual trail depicts the rotation of a bonus symbol. Each time the bonus symbol appears on the display, as it is spinning, a blurring effect is depicted trailing the bonus symbol. The blurring effect provides a way to visually emphasize the presence of the bonus symbol in the display region and, consequently, creating a sense of excitement in the player.

Optionally, a special sound is used in association or instead of the blurring effect. For example, the special sound is used to precede the appearance of the bonus symbol. Thus, the special sound creates a sense of anticipation for the player every time the bonus symbol is about to appear on the display.

Changes to any of the incrementing meters discussed above and to fixed jackpot signs are done, according to some embodiments, using a smooth transition between an initial state and a subsequent state. For example, when changing the font size of digits from a small font size to a large font size the change is done using a smooth animation, such as inflating the font size using a "ballooning effect." When the pay is complete the font size shrinks back to normal in a "reverse ballooning effect."

Each of these embodiments and obvious variations thereof is contemplated as falling within the spirit and scope of the claimed invention, which is set forth in the following claims.

What is claimed is:

1. A method of conducting a wagering game, comprising:

receiving via a wager input device a wager from a player for playing said wagering game;

displaying on a display an array of symbol-bearing locations and at least one payline along a plurality of said symbol-bearing locations, said plurality of said symbol-bearing locations including first and second non-adjacent outer locations said first and second non-adjacent outer locations being positioned on said display at respective ends of said array of symbol-bearing locations; and using one or more processors to evaluate; and symbols at said symbol-bearing locations along said payline for winning outcomes such that symbols at said first and second non-adjacent outer locations are evaluated in sequence.

2. The method of claim 1, wherein said payline starts at an inner location of said plurality of symbol-bearing locations.

3. The method of claim 1, further comprising displaying at least one of a payline-start and a payline-end for said payline.

4. The method of claim 1, further comprising selecting a set of paylines, each payline of said set of paylines starting at an inner location of said symbol-bearing locations.

5. The method of claim 1, further comprising sequentially indicating said plurality of said symbol-bearing locations included in said payline.

6. The method of claim 5, wherein said indicating includes lighting-up said symbol-bearing locations included along said payline.

7. The method of claim 1, further comprising sequentially indicating a plurality of winning symbols arranged along said payline when a randomly selected outcome is a winning outcome.

8. The method of claim 1, further comprising changing a meter characteristic for at least one incrementing meter when a meter change has occurred, wherein said meter characteristic is selected from a group consisting of a meter digit's size, a meter digit's color, a meter digit's font, and a meter window size.

9. The method of claim 8, further comprising scaling up a meter digit's size when said incrementing meter increases and scaling down said meter digit's size when said incrementing meter decreases.

10. The method of claim 8, wherein said incrementing meter is selected from a group consisting of a credits meter and a paid meter.

11. The method of claim 1, further comprising arranging said array of symbol-bearing locations in a plurality of reels, each of said plurality of reels having at least one symbol-bearing location of said array of symbol-bearing locations.

12. A computer readable storage medium or media is encoded with instructions for directing a gaming system to perform the method of claim 1.

13. A method of conducting a wagering game, comprising:

receiving a wager via a wager input device; and displaying on a display an array of symbol-bearing locations and at least one payline sequentially connecting first and second non-adjacent outer locations of said array with no intervening symbol-bearing location said first and second non-adjacent outer locations being positioned on said display at respective ends of said array of symbol-bearing locations.

14. The method of claim 13, further comprising:

arranging said away of symbol-bearing locations in a plurality of rotating reels, said away of symbol-bearing locations including a symbol combination; and preceding a special symbol of said symbol combination with a special sound before said symbol is displayed on a reel of said plurality of rotating reels while said reel is rotating.

15. The method of claim 13, further comprising:

arranging said away of symbol-bearing locations in a plurality of rotating reels, said away of symbol-bearing locations including a symbol combination; and trailing a special symbol of said symbol combination with a special indicator after said special symbol is displayed on a reel of said plurality of rotating reels while said reel is rotating.

16. The method of claim 13, further comprising displaying an animated sequence associated with an incrementing meter when a predetermined change in a value of said incrementing meter occurs.

17. A gaming system for conducting a wagering game, comprising:

an input device for receiving a wager;

a display for displaying an away of symbol-bearing locations and at least one payline along a plurality of said symbol-bearing locations, said plurality of said symbol-bearing locations including first and second non-adjacent outer locations that are positioned on said display at respective ends of said array of symbol-bearing locations; and a controller operative to evaluate symbols at said symbol-bearing locations along said payline for winning outcomes such that symbols at said first and second non-adjacent outer locations are evaluated in sequence.

18. The gaming system of claim 17, wherein said controller is located within said gaming terminal.

19. The gaming system of claim 17, wherein said payline starts at an inner location of said plurality of said symbol-bearing locations.

20. The gaming system of claim 17, wherein said display includes a payline start indicator for displaying a starting location of said active payline.

21. The gaming system of claim 17, wherein said display includes a sequentially displayed indicator for showing said payline.

22. The gaming system of claim 17, wherein said display includes a sequentially displayed indicator for showing said winning outcomes.

23. The gaming system of claim 17, wherein said display includes at least one incrementing meter having at least one meter characteristic selected from a group consisting of a meter digit's size, a meter digit's color, a meter digit's font, and a meter window size, said meter characteristic changing based on a value associated with said incrementing meter.

24. The gaming system of claim 23, wherein said at least one incrementing meter is selected from a group consisting of a credits meter and a paid meter.

25. The gaming system of claim 17, wherein said display includes at least one incrementing meter having at least one meter characteristic, said meter characteristic changing based on time elapsed since an occurrence of a previous winning jackpot.

26. A gaming system for conducting a wagering game, comprising:

an input device for receiving a wager; and a display for displaying an away of symbol-bearing locations and at least one payline sequentially connecting first and second non-adjacent outer locations of said array with no intervening symbol-bearing location said first and second non-adjacent outer locations being positioned on said display at respective ends of said array of symbol-bearing locations.

27. The gaming system of claim 26, further comprising a controller coupled to said display and programmed to arrange said array of symbol-bearing locations in a plurality of rotating reels.

* * * * *

UNITED STATES PATENT AND TRADEMARK OFFICE

CERTIFICATE OF CORRECTION

PATENT NO. : 7,618,315 B2
APPLICATION NO. : 11/351666
DATED : November 17, 2009
INVENTOR(S) : Thomas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 461 days.

Signed and Sealed this

Nineteenth Day of October, 2010

David J. Kappos

David J. Kappos
*Director of the United States Patent and Trademark Office*